US012268292B2

(12) United States Patent
Venditti et al.

(10) Patent No.: US 12,268,292 B2
(45) Date of Patent: Apr. 8, 2025

(54) BACKPACKS, BACKPACK SYSTEMS, BACKPACK INSERTS AND RELATED METHODS

(71) Applicant: Fowl, LLC, Cary, NC (US)

(72) Inventors: Chandler K. Venditti, Apex, NC (US); Bradley P. King, Apex, NC (US)

(73) Assignee: Fowl, LLC, Cary, NC (US)

( * ) Notice: Subject to any disclaimer, the term of this patent is extended or adjusted under 35 U.S.C. 154(b) by 0 days.

(21) Appl. No.: 17/543,527

(22) Filed: Dec. 6, 2021

(65) Prior Publication Data

US 2024/0188706 A1 Jun. 13, 2024

(51) Int. Cl.
*A45F 3/04* (2006.01)
*A45C 7/00* (2006.01)
(Continued)

(52) U.S. Cl.
CPC ..... *A45F 3/04* (2013.01); *A45C 7/009* (2013.01); *A45C 13/02* (2013.01); *A45C 13/1069* (2013.01); *A45F 2003/003* (2013.01)

(58) Field of Classification Search
CPC ..... A45C 7/005; A45C 7/009; A45C 7/0045; A45C 13/1069
See application file for complete search history.

(56) References Cited

U.S. PATENT DOCUMENTS 4,263,951 A * 4/1981 Siegel ..... A45C 3/06 D3/319
4,506,769 A * 3/1985 Franco ..... A45C 13/02 190/110
(Continued)

FOREIGN PATENT DOCUMENTS

CA 181124 3/2019
DE 102014000021 A1 * 7/2015 ..... A45C 13/02
(Continued)

OTHER PUBLICATIONS

Fowl, "The DukPak: The Perfect Bag for Travel, Adventure, and Life", <https://www.kickstarter.com/projects/1731960394/the-dukpak-the-perfect-bag-for-travel-adventure-an>, Jan. 24, 2018, 35 pages.
(Continued)

*Primary Examiner* — Scott T McNurlen
(74) *Attorney, Agent, or Firm* — Michael Best & Friedrich LLP

(57) ABSTRACT

Backpacks, backpack systems, backpack inserts and related methods are provided herein. A backpack can include a front wall, first and second side walls, a bottom extending between bottom portions of the front wall and the first and second side walls and a top panel extending between top portions of the front wall and the first and second side walls. The top panel can include a fastener for securing the top panel to the front wall and portions of the first and second side walls such that the top panel is openable and closeable. A rear panel is provided opposite the front wall and extending between first and second side walls, the bottom, and the top panel. The rear panel includes a fastener for securing the rear panel to the top panel and at least a portion of the first and second side walls such that the rear panel is openable and closeable. At least one fastener is positioned proximal the interior face of the top panel configured to engage a top panel of a backpack insert to permit opening the top panel of the insert when opening the top panel of the backpack.

11 Claims, 19 Drawing Sheets

(51) Int. Cl.

| | |
|---|---|
| ***A45C 13/02*** | (2006.01) |
| ***A45C 13/10*** | (2006.01) |
| *A45F 3/00* | (2006.01) |

(56) References Cited

U.S. PATENT DOCUMENTS

| | | | | |
|---|---|---|---|---|
| D382,772 | S | 8/1997 | Mogil | |
| D387,249 | S | 12/1997 | Mogil | |
| 6,336,577 | B1 | 1/2002 | Harris et al. | |
| 6,796,344 | B2 * | 9/2004 | Chen | A45C 1/024 150/113 |
| 8,251,113 | B2 * | 8/2012 | Baxter | A45C 1/024 150/900 |
| 8,794,492 | B2 * | 8/2014 | Ballou | B60R 11/00 224/539 |
| D834,895 | S | 12/2018 | Triska et al. | |
| D836,998 | S | 1/2019 | Jacobsen | |
| D867,823 | S | 11/2019 | Jacobsen | |
| D868,544 | S | 12/2019 | Lin et al. | |
| 10,544,976 | B2 | 1/2020 | Triska et al. | |
| D922,828 | S | 6/2021 | Munie et al. | |
| D968,072 | S | 11/2022 | Yang | |
| D972,372 | S | 12/2022 | Munie et al. | |
| 2018/0252458 | A1 | 9/2018 | Furneaux et al. | |
| 2018/0295959 | A1 * | 10/2018 | Derryberry | A45C 13/1069 |
| 2023/0139050 | A1 | 5/2023 | King | |

FOREIGN PATENT DOCUMENTS

| | | | | |
|---|---|---|---|---|
| KR | 301113202.0000 | | 6/2021 | |
| WO | WO-2017017596 | A1 * | 2/2017 | A45C 3/001 |

OTHER PUBLICATIONS

Haimont backpack cooler, posted at amazon.com, first available Mar. 21, 2022, retrieved on Aug. 30, 2023, online, https://www.amazon.com/Haimont-Insulated-Backpack-Leakproof-Lunchbox/dp/B09W2GMV8Q (Year: 2022).

Trypry cooler backpack, posted at amazon.com, first available Sep. 24, 2021, retrieved on Aug. 30, 2023, online, https://www.amazon.com/ TRYPRY-Backpack-Leakproof-Lightweight-Insulated/dp/B09H33SB22?th=1 (Year: 2021).

Zakeep cooler backpack, posted at amazon.com, first available Feb. 1, 2023, retrieved on Aug. 30, 2023, online, https://www.amazon.com/ ZAKEEP-Backpack-Capacity-Anti-Leaking-Adjustable/dp/BOBTM5DCJ3 (Year: 2023).

* cited by examiner

BACKPACKS, BACKPACK SYSTEMS, BACKPACK INSERTS AND RELATED METHODS

TECHNICAL FIELD

The presently disclosed subject matter relates to backpacks, backpack systems and backpack inserts and related methods. Specifically, the present subject matter relates to backpacks with strategically placed magnets therein and inserts, including a waterproof storage cooler insert that can be inserted or removed through a rear end of a backpack, held within the backpack using the magnets, and loaded through a top end of the backpack.

BACKGROUND

The use of backpacks is ubiquitous. Unfortunately, each backpack style is constructed and designed with a particular purpose in mind, which makes it difficult to find a backpack for everyday use. Further, the large cavities of many backpacks result in cluttered and disorganized storage of travel items. These same issues apply to coolers, which provide waterproof functionality, but whose design is rarely ergonomic, nor does it lend itself to multifunctional use.

Accordingly, there remains a need for an ergonomic backpack that provides organization, waterproof storage, and interchangeable functionality that addresses the various disadvantages associated with previous backpacks and coolers. Disclosed herein is a backpack having interchangeable inserts, that, in some embodiments, permits the backpack to function as a work bag, a cooler bag, and a travel bag.

SUMMARY

The present subject matter relates to backpacks, backpack systems and backpack inserts and related methods. In particular, the present subject matter relates to backpacks with strategically placed magnets therein and inserts, including a waterproof storage cooler insert, that can be inserted or removed through a rear end of a backpack. The magnets can help hold and align the inserts in the backpack while the contents of the inserts can be accessed through a top end of the backpack. Methods related to the use of the backpacks, backpack systems and backpack inserts are also provided.

While one or more objects of the presently disclosed subject matter having been stated hereinabove, and which is achieved in whole or in part by the presently disclosed subject matter, other objects will become evident as the description proceeds when taken in connection with the accompanying drawings as best described hereinbelow proceeds when taken in connection with the accompanying drawings as best described hereinbelow.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which:

FIG. 18 illustrates a rear perspective view of the embodiment of the backpack according to FIG. 1 and as shown in FIG. 8 with a rear panel of the backpack being unzipped and open with the cooler insert according to FIG. 14 inserted into the cavity of the backpack according to the present subject matter.

Figure 1:
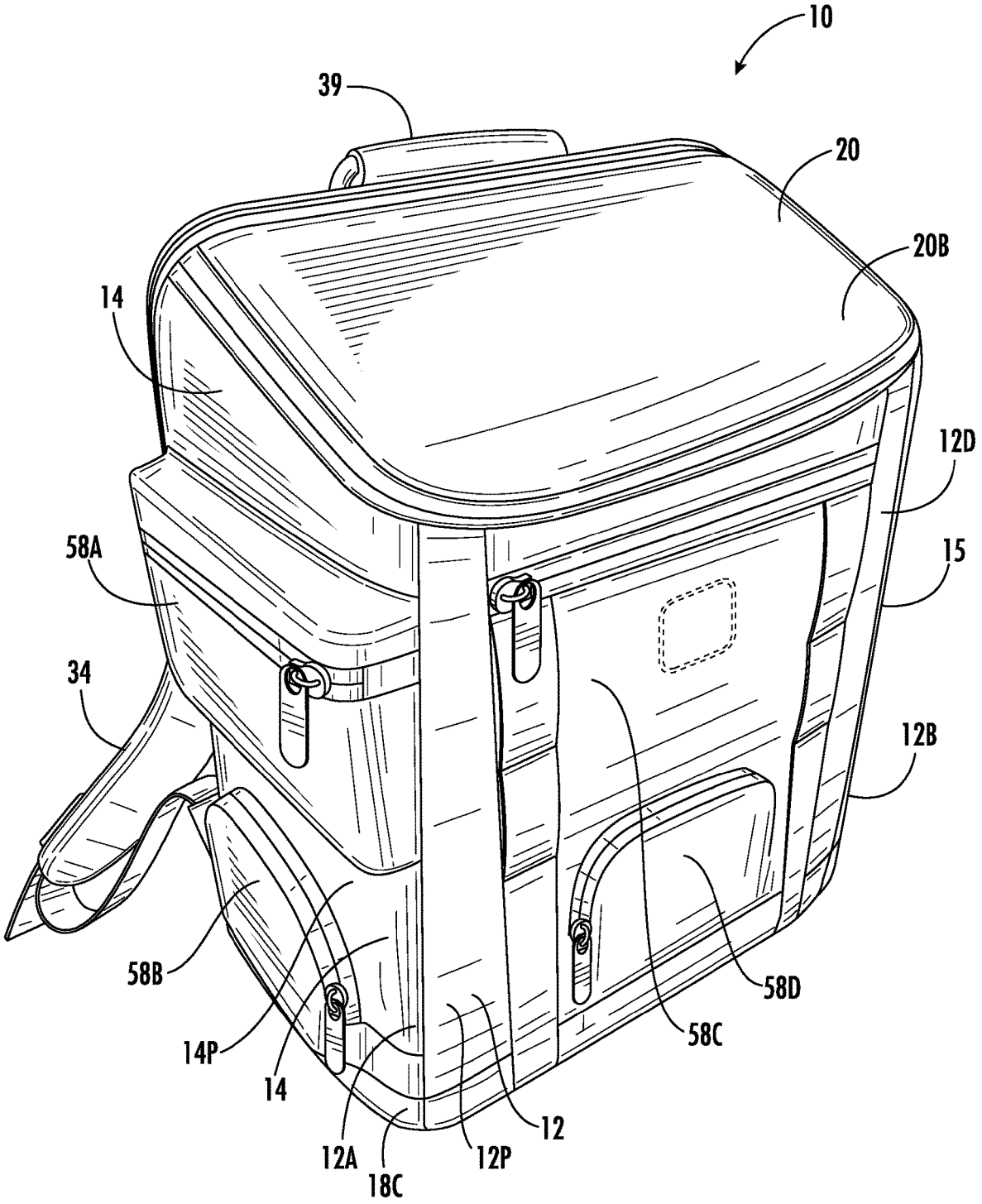
FIG. 1 illustrates a top perspective view of an embodiment of a backpack according to the present subject matter.
Figure 2:
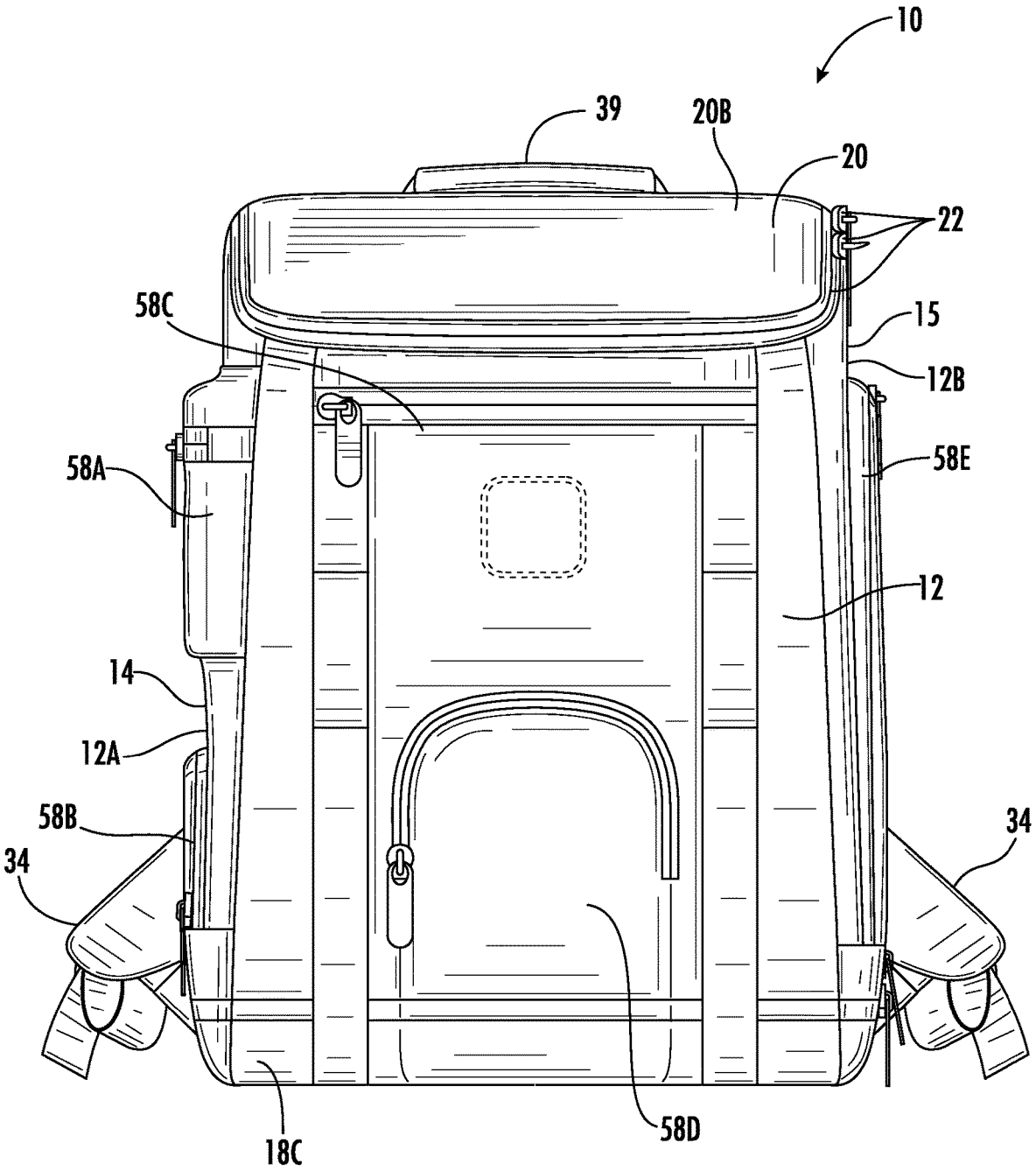
FIG. 2 illustrates a front side plan view of the embodiment of the backpack according to FIG. 1.

Repeat use of reference characters in the present specification and drawings is intended to represent the seam or analogous features or elements of the present subject matter.

DETAILED DESCRIPTION

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although the term "step" may be expressly used or implied relating to features of processes or methods, no implication is made of any particular order or sequence among such expressed or implied steps unless an order or sequence is explicitly stated.

Although the terms first, second, right, left, front, back, top, bottom, etc. may be used herein to describe various features, elements, components, regions, layers and/or sections, these features, elements, components, regions, layers and/or sections should not be limited by these terms. These terms are only used to distinguish one feature, element, component, region, layer, or section from another feature, element, component, region, layer, or section. Thus, a first feature, element, component, region, layer, or section discussed below could be termed a second feature, element, component, region, layer, or section without departing from the teachings of the disclosure herein.

Similarly, when a feature or element is being described in the present disclosure as "on" or "over" another feature or element, it is to be understood that the features or elements can either be directly contacting each other or have another feature or element between them, unless expressly stated to the contrary. Thus, these terms are simply describing the relative position of the features or elements to each other and do not necessarily mean "on top of" since the relative position above or below depends upon the orientation of the device to the viewer.

Embodiments of the subject matter of the disclosure are described herein with reference to schematic illustrations of embodiments that may be idealized. The drawings are not made necessarily to scale. Thus, not all embodiments within the scope of the drawings and these descriptions are made according to the apparent scale of the drawings with regard to relative dimensions in the drawings. As such, variations from the shapes and/or positions of features, elements, or components within the illustrations as a result of, for example but not limited to, user preferences, manufacturing techniques and/or tolerances are expected. Shapes, sizes and/or positions of features, elements or components illustrated in the figures may also be magnified, minimized, exaggerated, shifted, or simplified to facilitate explanation of the subject matter disclosed herein. Thus, the features, elements or components illustrated in the figures are schematic in nature and their shapes and/or positions are not intended to illustrate the precise configuration of the subject matter and are not necessarily intended to limit the scope of the subject matter disclosed herein unless it specifically stated otherwise herein.

Any dimensions expressed or implied in the drawings and these descriptions are provided for exemplary purposes. Thus, not all embodiments within the scope of the drawings and these descriptions are made according to such exemplary dimensions. It is to be understood that the ranges and limits mentioned herein include all ranges located within the prescribed limits (i.e., subranges). For instance, a range from about 100 to about 200 also includes ranges from 110 to 150, 170 to 190, 153 to 162, and 145.3 to 149.6. Further, a limit of up to about 7 also includes a limit of up to about 5, up to 3, and up to about 4.5, as well as ranges within the limit, such as from about 1 to about 5, and from about 3.2 to about 6.5.

The presently disclosed subject matter relates to backpacks, backpack systems and backpack inserts. Specifically, the present subject matter relates to backpacks with strategically placed magnets therein and inserts, including a waterproof storage cooler insert, that can be inserted or removed through a rear end of a backpack, held within the backpack using the magnets, and loaded through a top end of the backpack.

For example, the presently disclosed subject matter provides a backpack that can comprise a front wall having an interior face and an exterior face as well as a first side wall extending from a first side of the front wall and a second side wall extending from a second side of the front wall opposite the first side wall. The backpack can also comprise a bottom extending between bottom portions of the front wall and the first and second side walls and a top panel having an interior face and exterior face and extending between top portions of the front wall and the first and second side walls. The top panel can comprise a fastener for securing the top panel to the front wall and at least a portion of the first and second side walls such that the top panel is openable and closeable. The backpack can further a rear panel opposite the front wall and extending between first and second side walls, the bottom, and the top panel. The rear panel can include a fastener for securing the rear panel to the top panel and at least a portion of the first and second side walls such that the rear panel is openable and closeable. Additionally, the backpack can comprise at least one fastener positioned proximal the interior face of the top panel configured to engage a top panel of a backpack insert to permit the opening the top panel of the insert when opening the top panel of the backpack.

Similarly, the presently disclosed subject matter provides a backpack system that can comprise a backpack as described above and can include a cooler insert as well as other removable inserts and a computer sleeve insert. These inserts can be interchanged depending on the user's preference and the intended use of the backpack at the given time. For example, the cooler insert can be constructed of waterproof and insulating material. The cooler insert can comprise a front wall having an interior face and an exterior face and a first side wall extending from a first side of the front wall and a second side wall extending from a second side of the front wall opposite the first side wall. The cooler insert can also comprise a rear wall opposite the front wall and extending between first and second side walls and a bottom extending between bottom portions of the front wall, rear wall, and the first and second side walls. Additionally, the cooler insert can comprise a top panel having an interior face and exterior face and extending between top portions of the front wall, the rear wall and the first and second side walls. The top panel can comprise a fastener, such as a waterproof zipper, for securing the top panel to the front wall and at least a portion of the first and second side walls such that the top panel is openable and closeable. Further, the cooler insert can comprise at least one fastener positioned proximal the exterior face of the top panel configured to engage the at least one fastener on the interior face of the top panel of the backpack to permit the opening of the top panel of the cooler insert when opening the top panel of the backpack. For example, in some embodiments, the at least one fastener on the top panel of the backpack can comprise one or more magnets and the at least one fastener on the top panel of the cooler insert can comprise one or more magnets.

Other removable inserts can be provided that can be used for other purposes. In some embodiments, the backpack of the backpack system can further comprise a first front wall magnet and a second front wall magnet positioned in a horizontal plane on a middle portion of the interior face of the front wall, the first and second front wall magnets configured to hold an insert in an interior cavity of the backpack formed by the front wall, the bottom, and the first and second side walls. In such embodiments, one or more other removable inserts can be provided. The insert can comprise a front wall having an interior face and an exterior face as well as a first side wall extending from a first side of the front wall and a second side wall extending from a second side of the front wall opposite the first side wall. Such an insert can also comprise a rear wall opposite the front wall and extending between first and second side walls and a bottom extending between bottom portions of the front wall, rear wall, and the first and second side walls. The front wall, rear wall, bottom and first and second side walls can form an interior cavity with opening at the top of the insert for accessing the cavity. Additionally, the insert can comprise a first front wall magnet and a second front wall magnet positioned in a horizontal plane on a middle portion of the exterior face of the front wall of the insert. The first and second front wall magnets on the insert can be configured to engage the first and second front wall magnets on the interior face of the front wall of the backpack to hold the inserts in the interior cavity of the backpack. Additionally, in some embodiments, the bottom of the backpack and the bottom of the inserts, including the cooler inserts can have one or more magnets thereon to also aid in holding the inserts in the cavity of the backpack. These and other features of the backpacks and backpack systems are described in more detail below with reference to the figures.

Referring to FIGS. 1-9, an embodiment of a backpack, generally 10 is provided. The backpack 10 can comprise a front wall 12, a first side wall 14, a second side wall 15, a rear panel 16, a bottom 18, and a top panel 20 that form a cavity 25 in which removable inserts and items to be carried can be inserted and safely stored to transport within the backpack 10. In some embodiments, the front wall 12 can comprise a front panel 12P, the first and second side walls 14, 15 can comprise a first side panel 14P secured to a first side 12A of the front panel 12P and second side panel 15P secured to a second side 12B of the front panel 12P and the bottom 18 can comprise a bottom panel 16P secured to bottom portions of the front panel 12P and the first and second side panels 14P, 15P.

Figure 9:
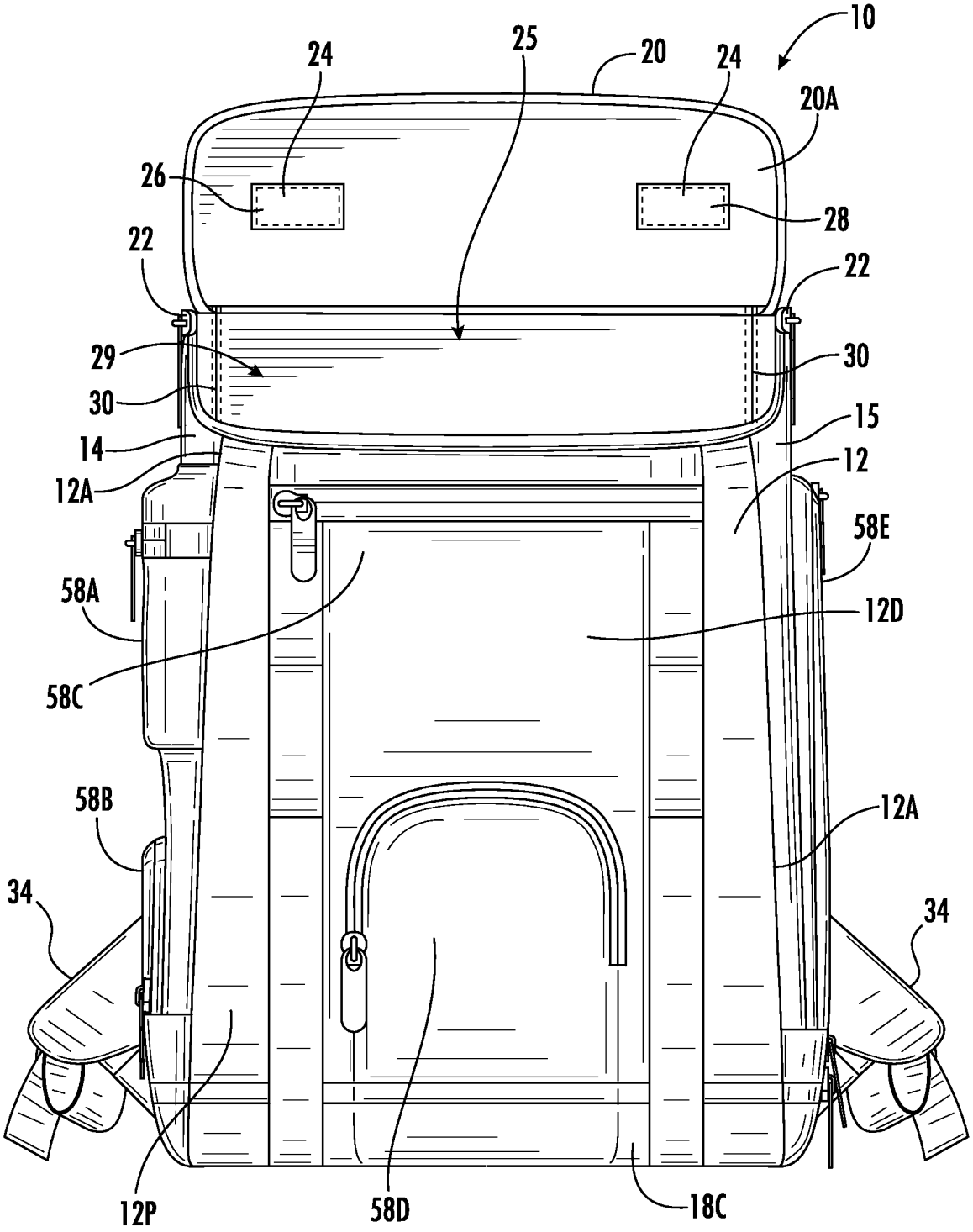
FIG. 9 illustrates a font side plan view of the embodiment of the backpack according to FIG. 1 with a top panel in an open position according to present subject matter.

The top panel 20 can comprise an interior face 20A (see FIG. 9) and exterior face 20B and extending between top portions of the front wall 12 and the first and second side walls 14, 15. The top panel 20 can comprise a fastener 22, such as a zipper as shown, for securing the top panel 20 to the front wall 12 and at least a portion of the first and second side walls 14, 15 such that the top panel 20 is openable and closeable. The zipper 22 can be a waterproof zipper with two sliders 22A, 22B. When the top panel 20 is opened as shown in FIG. 9, an opening 29 is formed that provides access to cavity 25 of the interior of the backpack 10. In this manner, when an insert is loaded into the backpack 10, contents in the inserts can be access by opening the top panel 20 without having to remove the inserts from the backpack 10. When the top panel 20 is closed and the zipper 22 is shut, the opening 29 is closed and cavity 25 is enclosed. Additionally, the top panel 20 of the backpack 10 can comprise at least one fastener 24 that can be used to engage an openable top panel of a removable insert such that when the removable insert is placed in the cavity 25 of the backpack 10 and the at least one fastener 24 engages the top panel of the removable, the top panel of the insert opens with opening the top panel 20 of the backpack 10. For example, in some embodiments of the backpack 10 as shown, the at least one fastener 24 of the panel 20 of the backpack 10 can comprise a first magnet 26 and a second magnet 28 positioned proximal the interior face 20A of the top panel 20. As will be explained in further detail below, the first and second magnets 26, 28 can be configured to engage a top panel of a removable insert, such as a cooler insert, to permit the opening the top panel of the insert when opening the top panel 20 of the backpack 10.

Figure 3:
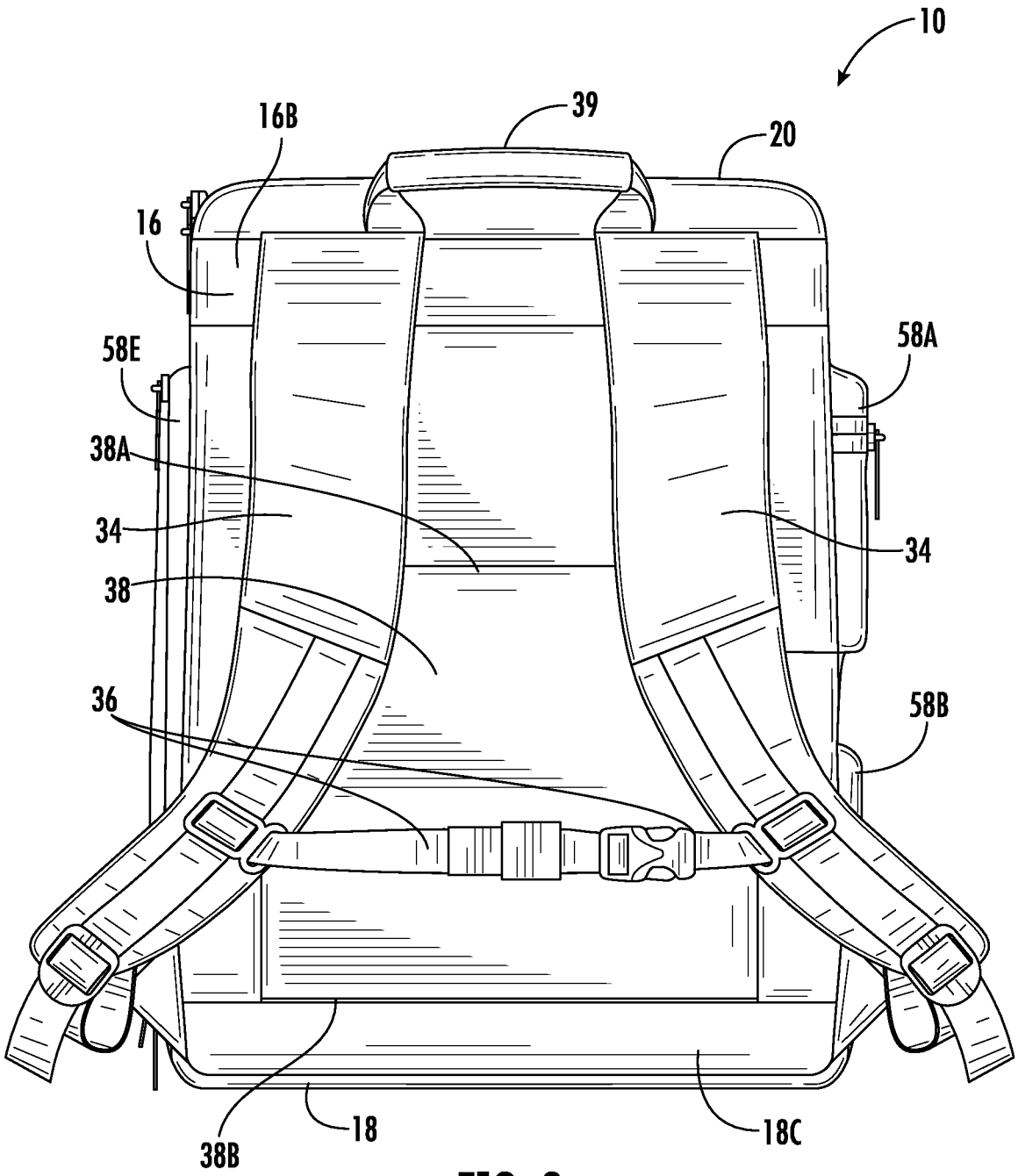
FIG. 3 illustrates a rear side plan view of the embodiment of the backpack according to FIG. 1.
Figure 4:
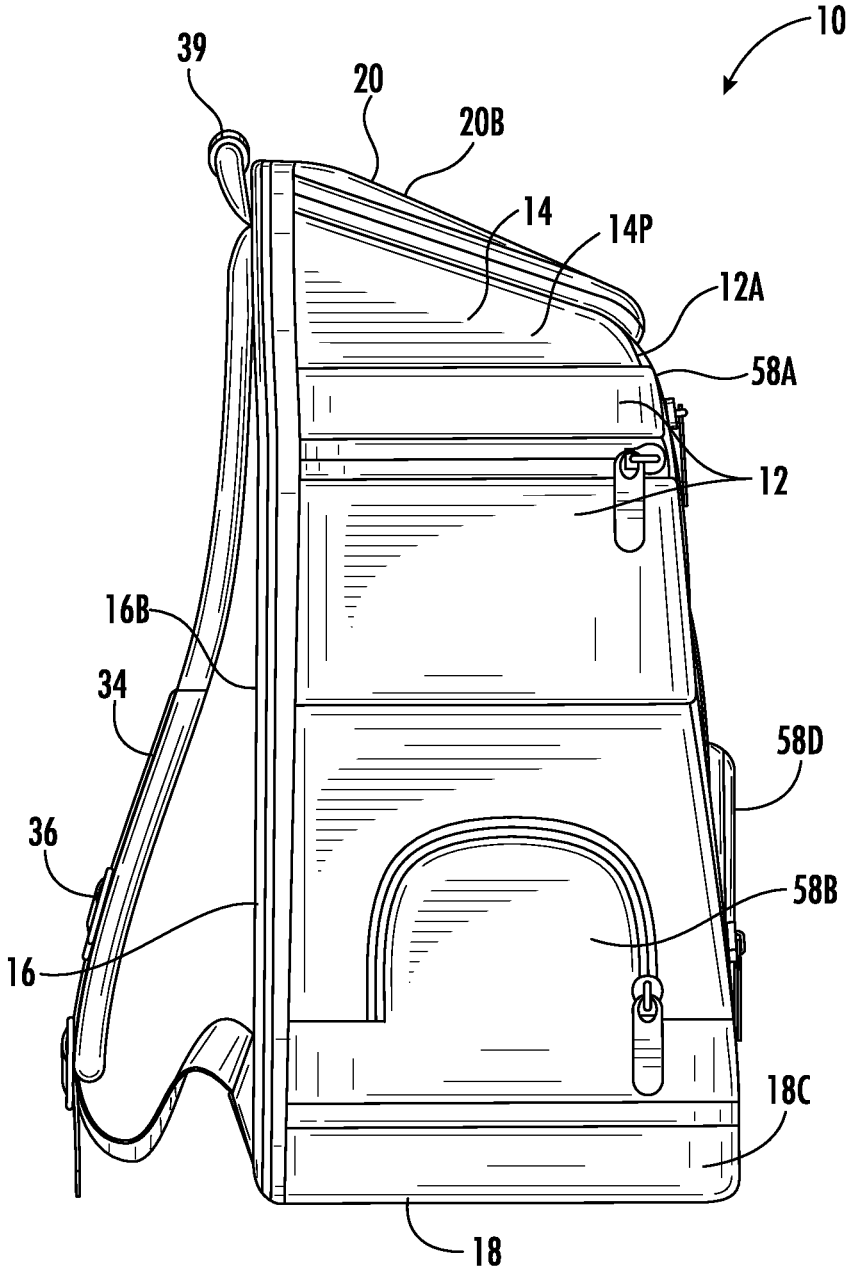
FIG. 4 illustrates a right side plan view of the embodiment of the backpack according to FIG. 1.
Figure 5:
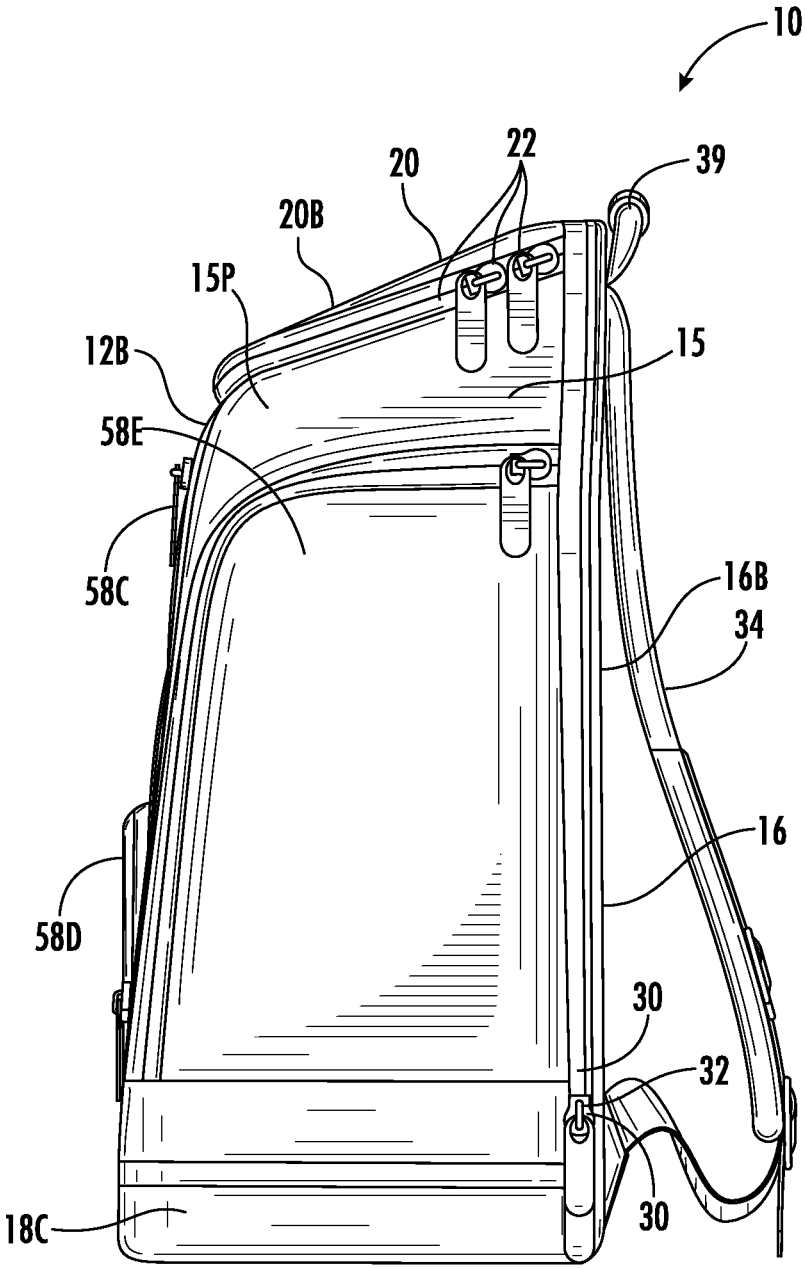
FIG. 5 illustrates a left side plan view of the embodiment of the backpack according to FIG. 1.
Figure 6:
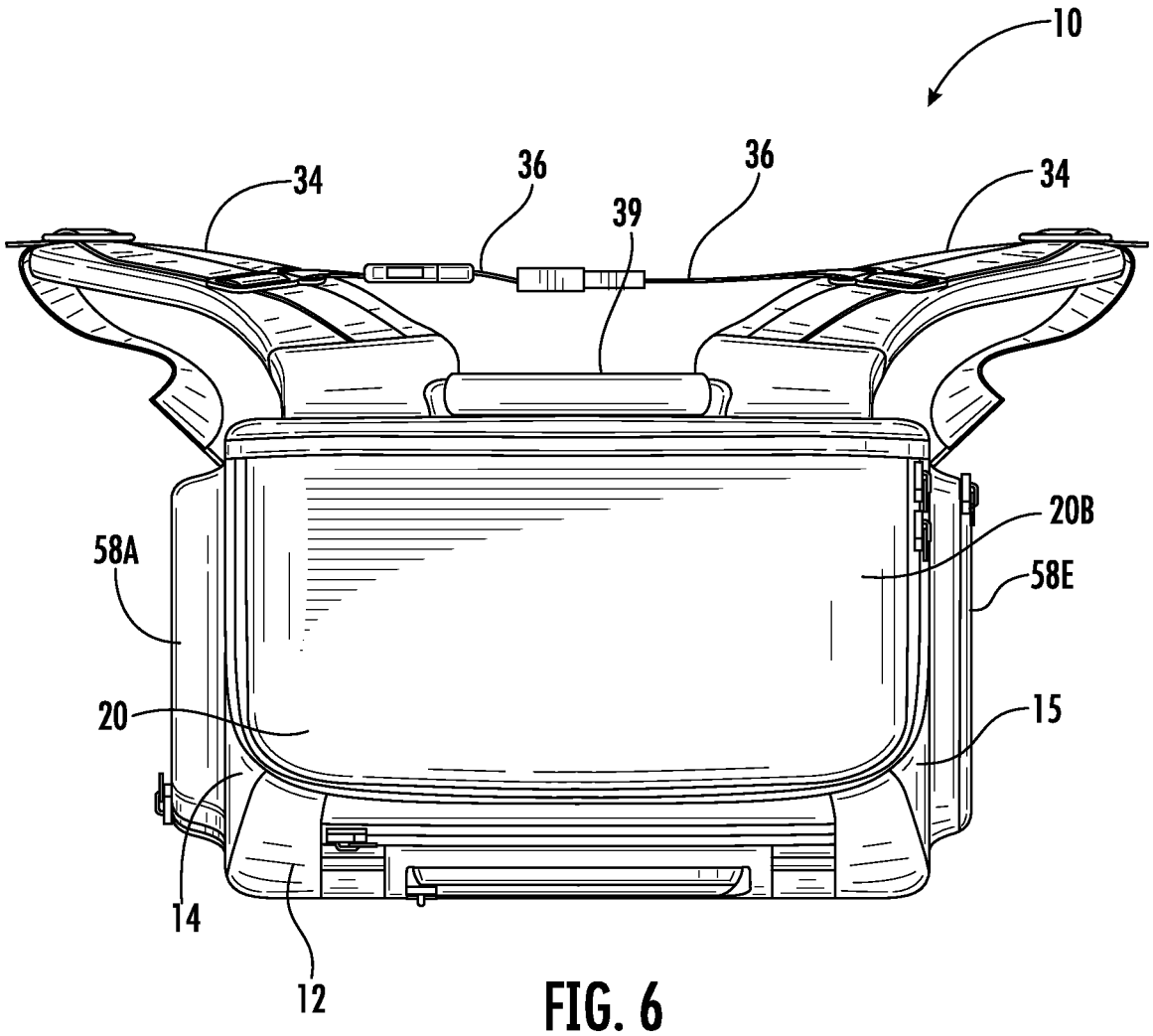
FIG. 6 illustrates a top plan view of the embodiment of the backpack according to FIG. 1.
Figure 8:
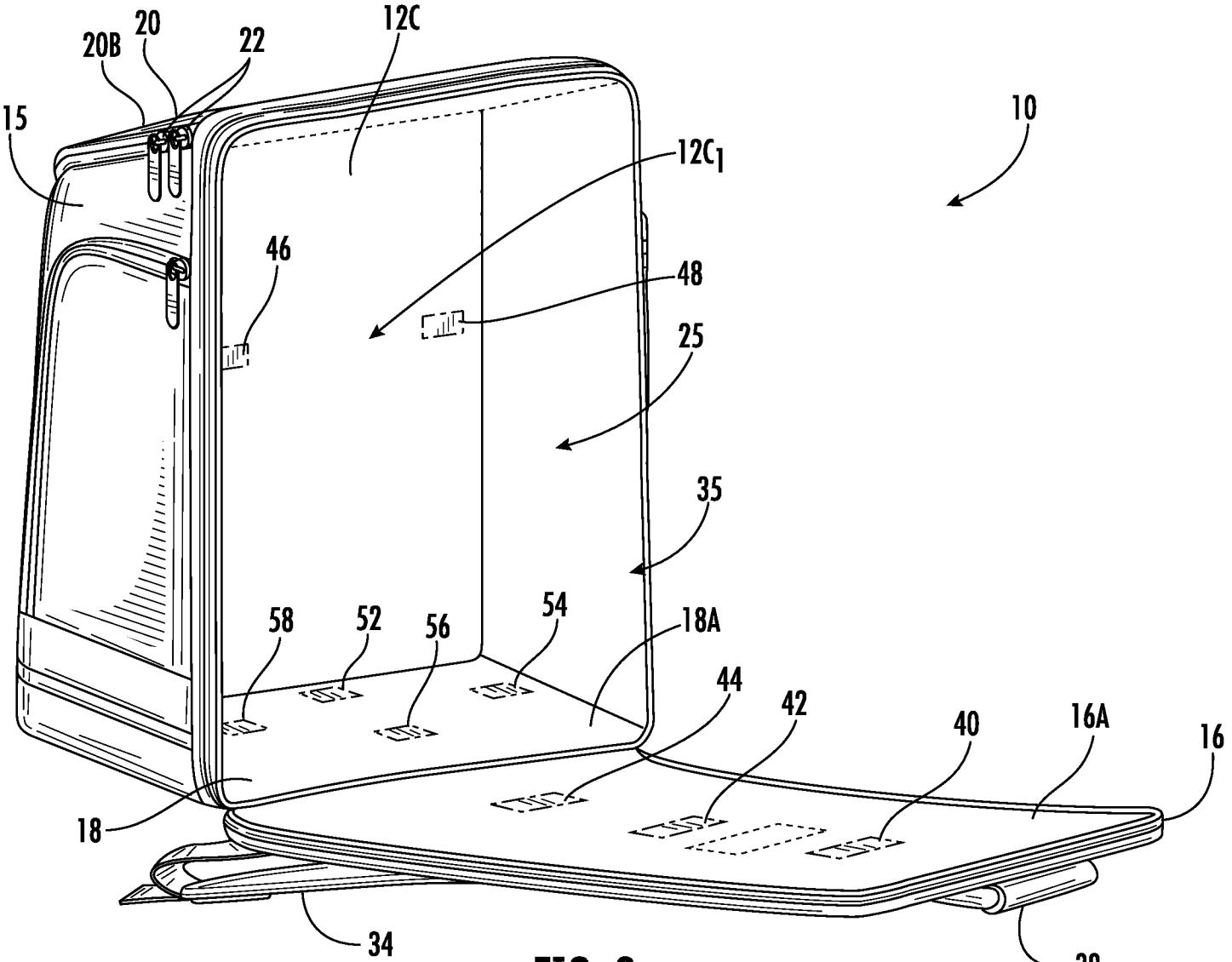
FIG. 8 illustrates a rear perspective view of the backpack as shown in FIG. 1 with a rear panel being unzipped and open showing an interior of the backpack according to the present subject matter.

The rear panel 16 can be opposite the front wall 12 and extending between first and second side walls 14, 15, the bottom 18, and the top panel 20 and can also be openable and closeable to permit access to the cavity 25 of the interior of the backpack 10. The rear panel 16 can comprise an interior face 16A (see FIG. 8) and an exterior face 16B. The rear panel 16 can comprise a fastener 30, for example a zipper that includes one or more sliders 32 for opening and closing the rear panel 16. In particular, the zipper 30 can be used for securing the rear panel 16 to the top panel 20 and at least a portion of the first and second side walls 14, 15 such that the rear panel 16 is openable and closeable. The advantageous positioning of the rear zipper 30 along three of the four edges of the rear panel 16 permits the rear panel 16 to be pivoted about the bottom edge of the rear panel 16 and the bottom 18 and exposing the interior cavity 25 of the backpack 10. For example, the rear panel 16 can lay substantially flat when opened as shown in FIG. 8, at about an 85° angle to about a 100° angle relative to the position of the rear panel 16 when the rear panel 16 is engaged with the top panel 20 (as seen in FIGS. 3-5).

The ability to open and close the rear panel 16 allows the formation of a larger opening 35 that can be used load removable inserts into the cavity 25 of the interior of the backpack 10 as explained further below or for easier packing and access of the cavity 25 than the convenient top panel opening 29. While the rear opening 35 permits contents and/or the insert to be loaded and unloaded for travel, the top opening 29 enables quick and efficient access to contents stored within the insert and/or the cavity 25 of the backpack 10. Providing a backpack 10 having a rear opening 35 for initial packing and unpacking of the larger insert and/or contents and having a top opening 29 for allowing quick-access management of the contents, the backpack 12 disclosed herein provides advantageous versatility.

The rear panel 16 can also comprise shoulder straps 34 that are attached to the exterior face 16B of the rear panel 16 to allow the user to carry the backpack 10 on their back. The shoulder straps 34 can be adjustable and can include cross straps 36 for ergonomic comfort. Additionally, the exterior face 16B of the rear panel 16 can include a carrier sleeve 38 that is open at a top 38A and a bottom 38B as shown in FIG. 3. The carrier sleeve 38 can allow for insertion of an extendable handle on rollable luggage or a rollable briefcase such that the backpack 10 can be transported with rollable luggage or briefcase, for example, when walking in an airport. Additionally, the backpack 10 can include a handle 39 at the top of the rear panel 16 that can be used to carrier the backpack 10 in one hand by the user, Referring to FIG. 8, the rear panel 16 can further comprise one or more fasteners, such as one or more magnets, that can be used to hold a removable insert to the rear panel. For example, in some embodiments, the rear panel 16 can further comprise an upper rear panel magnet 40, a middle rear panel magnet 42 and a lower rear panel magnet 44 positioned in a vertical plane on a middle portion 16$A_1$ of the interior face 16A of the rear panel 16. The upper, middle, and lower rear panel magnets 40, 42, 44 can be configured to removably hold inserts, such as a computer sleeve insert, to the interior face 16B of the rear panel 16 of the backpack 10. Additionally, the upper, middle, and lower rear panel magnets 40, 42, 44, individually or together, can be used to help hold removable inserts of the backpack 10 in place while the top panel 20 and rear panel 16 are closed and the backpack 10 is in transport.

Similarly, the front wall 12 can comprise an interior face 12C and an exterior face 12D. As can been seen in FIG. 8, the front wall 12 can comprise one or more fasteners that can be used to help align and hold an insert in the cavity 25 of the backpack 10. In some embodiments, the front wall 12 can comprise one or more fasteners positioned along a middle portion 12$C_1$ of the interior face 12C of the front wall 12. For example, in some embodiments as shown, the front wall 12 can comprise a first front wall magnet 46 and a second front wall magnet 48 positioned along a middle portion 12$C_1$ of the interior face 12C of the front wall 12. The first and second front wall magnets 46, 48 can also be configured to aid in holding a removable insert in the cavity 25 of the backpack 10 formed by the front wall 12, the bottom 18, and the first and second side walls 14, 15 as explained further below. For example, first and second front wall magnets 46, 48 can be positioned in a horizontal plane on a middle portion 12$C_1$ of the interior face 12C of the front wall 12.

In some embodiments, the one or more fasteners in the form of one or more magnets 46, 48 can have a stronger magnetic field strength, i.e., a stronger magnetic pull, than the magnetic field strength, i.e., magnetic pull, of any individual upper, middle, and lower rear panel magnets 40, 42, 44 on the rear panel 16. In some embodiments, the one or more fasteners in the form of one or more magnets 46, 48 can have a stronger magnetic field strength, i.e., a stronger magnetic pull, than the collective magnetic field strength, i.e., magnetic pull, of the upper, middle, and lower rear panel magnets 40, 42, 44 on the rear panel 16. For example, in some embodiments, the first and second front wall magnets 46, 48 combined can have a stronger magnetic pull than the magnetic pull of the middle rear panel magnet 44, such that an insert that is engaged by the wall magnets 46, 48 and the middle rear panel magnet 44 when the rear panel 16 is closed will stay in the cavity 25 of the interior of the backpack 10 when the rear panel 16 is opened again. For example, in some embodiments, an insert having a front facing wall with two magnets can be aligned with the first and second front wall magnets 46, 48 of the front wall 12 of the backpack 10 and a rear facing wall with a single magnet that aligns with the middle rear panel magnet 44 of the rear panel 16 so that when the rear panel 16 moves to an opened position, the insert stays within the cavity 25 of the backpack 10.

Figure 7A:
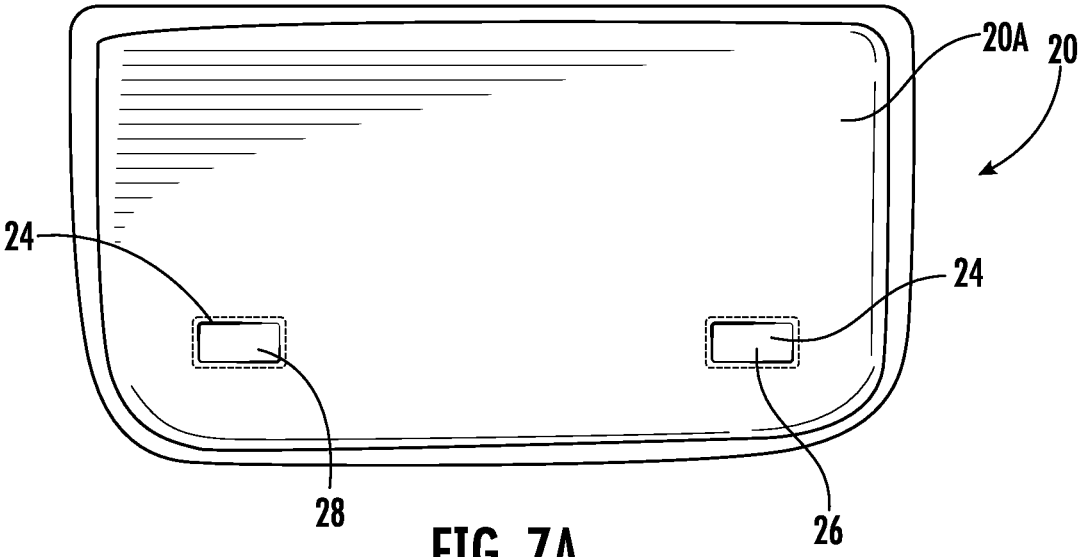
FIG. 7A illustrates a top plan view of an embodiment of an interior face of a top panel of an embodiment of a backpack according to the present subject matter.
Figure 7B:
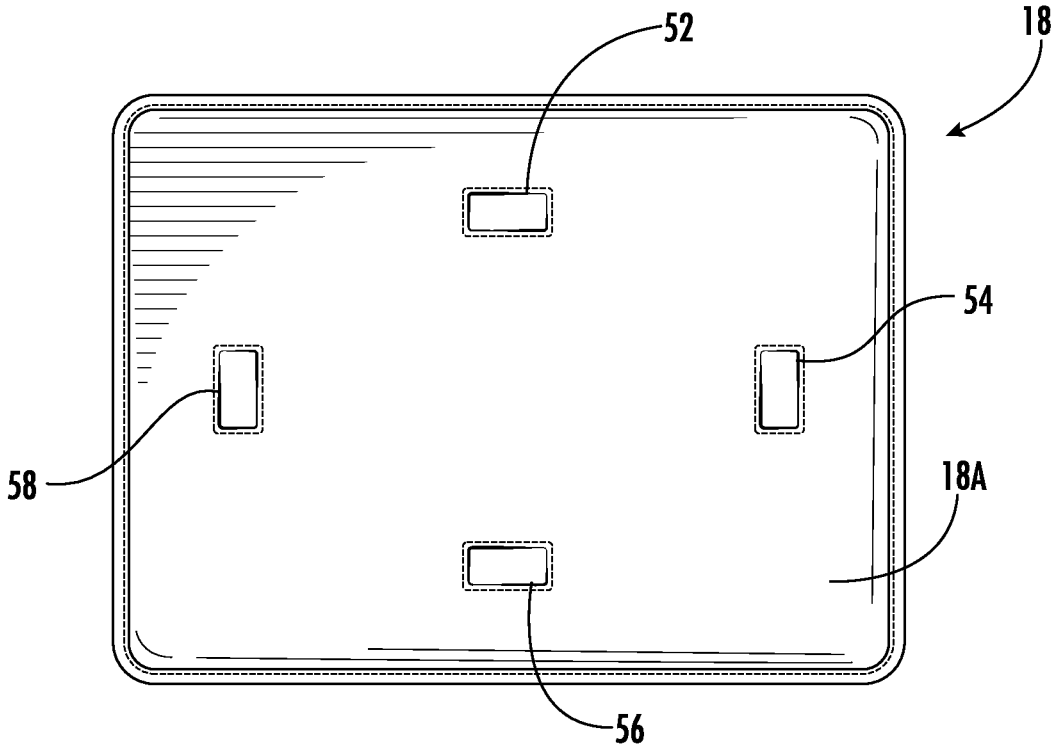
FIG. 7B illustrates a top plan view of an embodiment of an interior face of a bottom or floor of an embodiment of a backpack according to the present subject matter.

Additionally, to help hold an insert in the cavity 25 of the interior of the backpack 10, the bottom 18 can have one or more fasteners thereon. The bottom 18 can comprise an interior face 18A and an exterior face (not shown). As shown in FIGS. 7B and 8, one or more bottom magnets 50, 52, 54, 56 can be positioned proximal to the interior face 18A of the bottom 18. The one or more bottom magnets 50, 52, 54, 56 configured to removably hold a removable insert in the interior cavity 25 of the backpack 10 formed by the front wall 12, the bottom 18, and the first and second side walls 14, 15. For example, as shown in FIGS. 7B and 8, one or more bottom magnets 50, 52, 54, 56 comprises four magnets positioned proximal to four sides of the bottom 18 of the backpack 10. The bottom magnets 50, 52, 54, 56 may assist the insertion of the removable inserts by 'snapping' the insert into proper position and alignment. Further, the bottom magnets 50, 52, 54, 56 may minimize the chance of the insert sliding out of position when the top panel 20 and/or rear panel 16 is open.

The backpack 10 can have a number of pockets 58A-58E on the front wall 12 and the first and second side walls 14, 15 of different sizes that can be used for different purposes. Each of the pockets 58A-58E can have one or more fasteners, such as zippers 59 for opening and closing the pockets 58A-58E. The mouths and openings of the pockets 58A-58E can be different sizes and shapes that can be designed for specific uses. Thus, each pocket 58A-58E may be sized and configured for a unique purpose. Additionally, the backpack 10 can comprise a bottom band 18C that may reinforce the strength of the bottom panel 18A, as well as the bottom portions of the front wall 12, the first and second side walls 14, 15 and the rear panel 16 and/or provide enhanced moisture repellency of the bottom 18 of the backpack 12.

Figure 10:
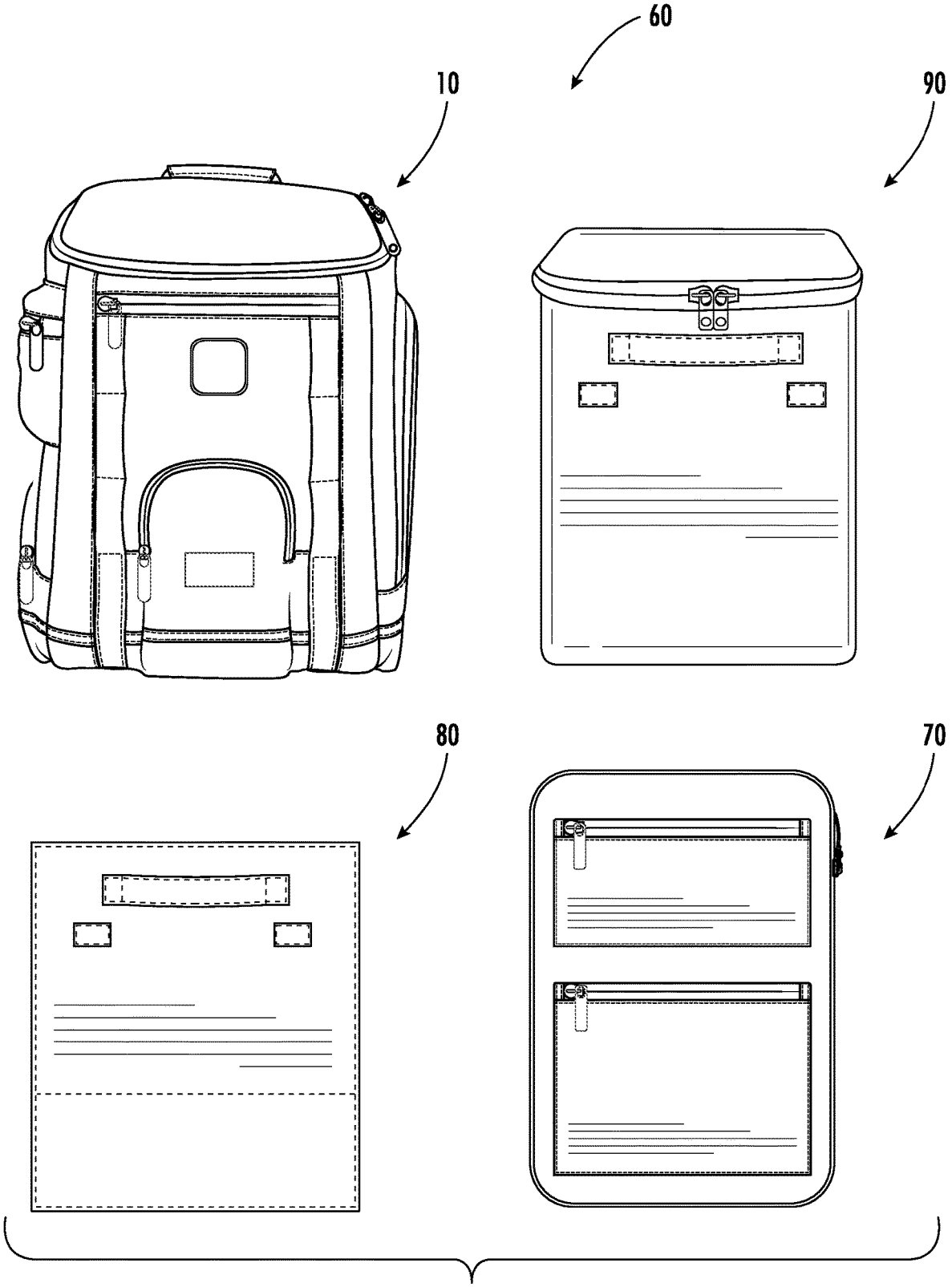
FIG. 10 illustrates a schematic view of an embodiment of a backpack system according to the present subject matter.

Referring to FIG. 10, an embodiment of a backpack system 60 is provided that can include a backpack 10 as described above and one or more inserts, such as a computer sleeve insert 70, an organizing insert 80 and a cooler insert 90. Each of the computer sleeve insert 70, an organizing insert 80 and a cooler insert 90 can be inserted into the cavity 25 of the backpack 10 through the rear opening 35 of the rear panel 16. Each of these embodiments of inserts will be described in more detail.

Figure 11:
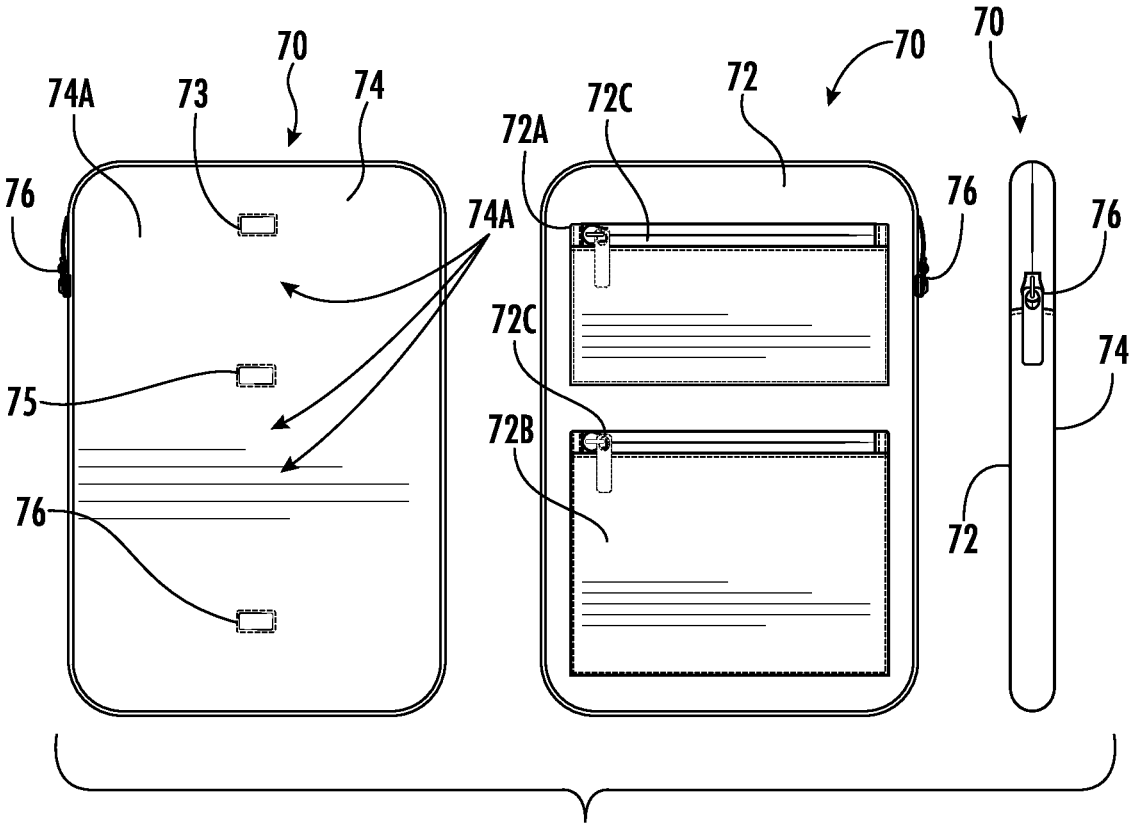
FIG. 11 illustrates a rear plan view and front plan view and aside plan view of an embodiment of a computer sleeve insert for an embodiment of the backpack system according to the present subject matter.

As shown in FIG. 11, the computer sleeve insert 70 can comprise a front sleeve panel 72 and a rear sleeve panel 74 that can be connected to each other and can have a fastener, such as a zipper 76, that can open and close to provide access to an interior of the computer sleeve insert 70. The computer sleeve insert 70 can be used to safely carry and protect a tablet or a laptop computer. As shown, in some embodiments, the front sleeve panel 72 can have one or more closable pockets 72A, 725 for holding contents. For example, the pockets 72A, 72B can be used for storage of items related to the laptop that is placed in the computer sleeve insert 70, such as chargers, memory drives, and other connectable devices or items. A lower pocket 72B can be larger than the upper pocket 72A. The pockets 72A, 72B may be sealable with one or more fasteners, such as zippers 72C.

The computer sleeve insert 70 can have one or more fasteners that correspond to and match with the one or more fasteners on the rear panel 16 of the backpack 10. The one or more fasteners on the computer sleeve insert 70 and the one or more fasteners on the rear panel 16 of the backpack 10 can be used for aligning and maintaining the position of the computer sleeve insert 70 with respect to the rear panel 16 of the backpack 10. For example, in some embodiments, as show in FIG. 11, the rear panel 74 of the computer sleeve insert 70 can comprise an interior face (not shown) and an exterior face 74A and can further comprise an upper rear sleeve panel magnet 73, a middle rear sleeve panel magnet 75 and a lower rear sleeve panel magnet 77. The upper rear sleeve panel magnet 73, the middle rear sleeve panel magnet 75 and the lower rear sleeve panel magnet 77 can be positioned in a vertical plane on a middle portion 74$A_1$ of the exterior face 74A of the rear sleeve panel 74 with the upper, middle, and lower rear sleeve panel magnets 73, 75, 77 configured to engage the upper, middle, and lower rear sleeve panel magnets 40, 42, 44 on the interior face 16$A_1$ of the rear panel 16 of the backpack 10 to removably hold the computer sleeve insert 70 to the interior face 16$A_1$ of the rear panel 16 of the backpack 10. The computer sleeve insert 70 may be aligned with the rear panel 16 of the backpack 10 when the rear panel 16 of the backpack 10 is pivoted open, fully or partially, thereby ensuring the computer sleeve insert 70 properly fits within the cavity 25 of the backpack 10 as the rear panel 16 of the backpack 10 is then pivoted closed and the computer sleeve insert 70 is fully positioned within the cavity 25 of the backpack 10.

The backpack system 60 can include one or more removable organizing inserts 80 can be provided to hold whatever the user wants, and the contents can be organized in the removable insert 80 outside the backpack 10 and then inserted into the backpack 10 through the opening of the rear pane 16. Each insert 80 can have a same or different configuration and can be interchangeable within the same cavity 25 of the backpack 10. For example, in some embodiments, the removable inserts 80 can have different sleeve and/or divider configurations within the cavities of the removable inserts 80. For example, the removable inserts 80 can have sleeves and/or dividers configured for work related storage, travel related storage, activity-specific related storage or the like. In some embodiments, some of the removable inserts 80 can have an open cavity without sleeves or dividers crossing the cavity as will be explained further below.

Figure 12:
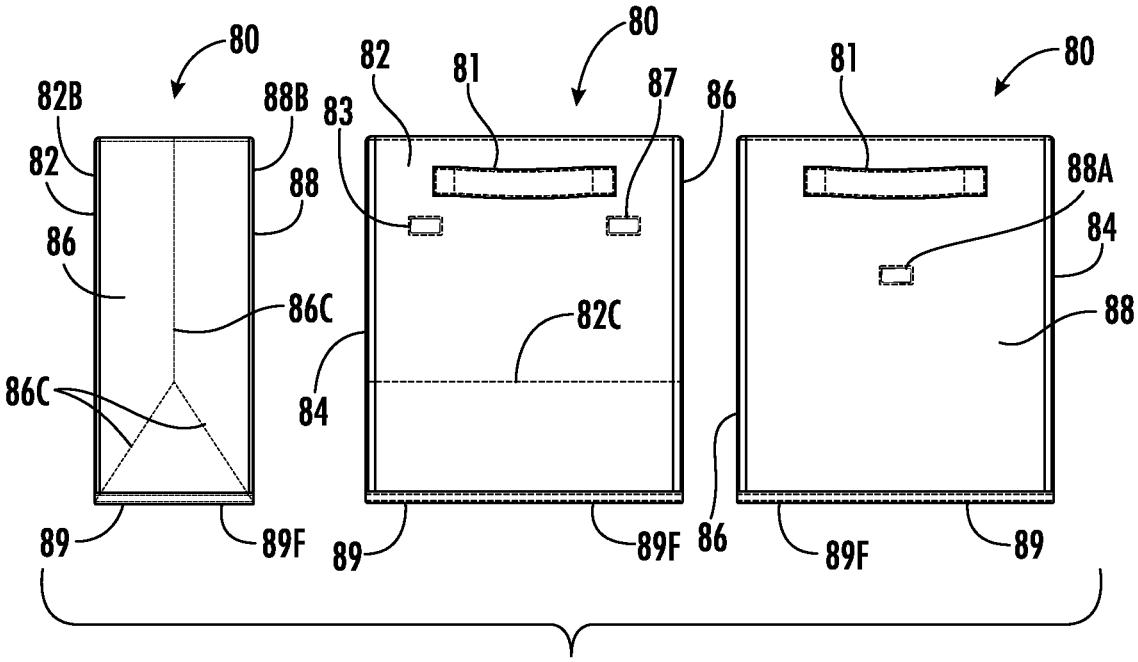
FIG. 12 illustrates a rear plan view and front plan view and a side plan view of an embodiment of a removable insert for an embodiment of the backpack system according to the present subject matter.
Figure 13A:
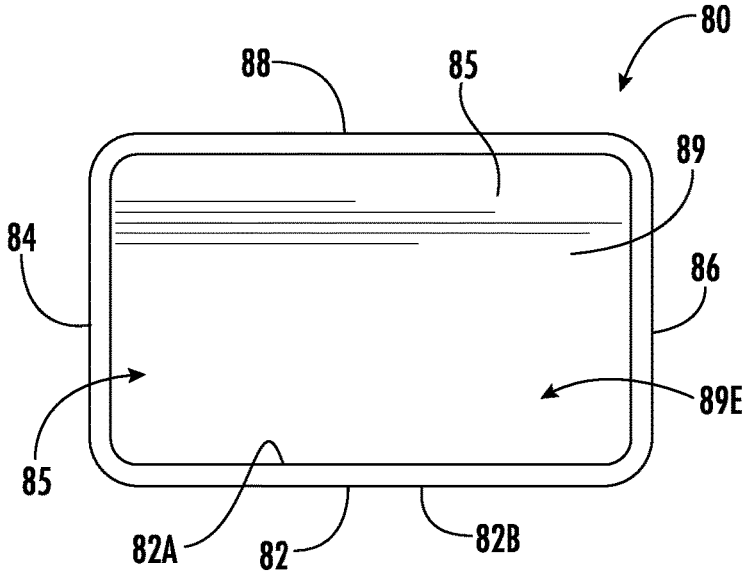
FIGS. 13A and 13C illustrates a top plan view of the embodiment of the removable insert according to FIG. 12 for an embodiment of the backpack system according to the present subject matter.
Figure 13B:
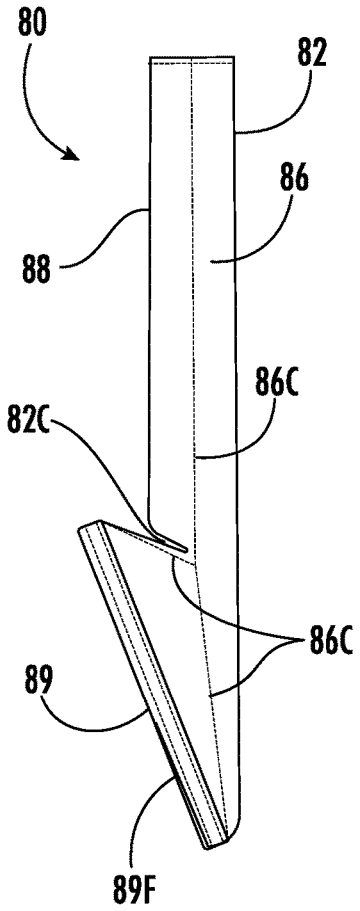
FIG. 13B illustrates a top plan view of the embodiment of the removable insert according to FIG. 12 in a folded position.
Figure 13C:
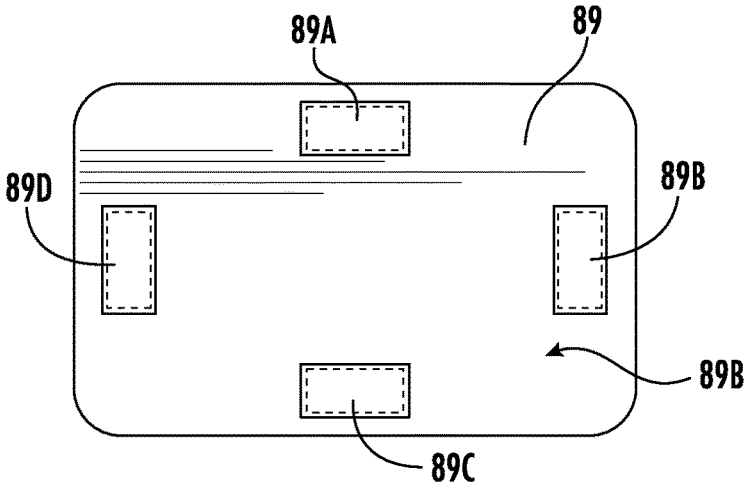

Referring to FIGS. 12-13C, an embodiment of a removable insert 80 can be provided that has an open cavity 85. The removable insert 80 can comprise a front wall 82 having an interior face 82A and an exterior face 82B and a first side wall 84 extending from a first side of the front wall 82 and a second side wall 86 extending from a second side of the front wall 82 opposite the first side wall 84. The inset 80 can also comprise a rear wall 88 opposite the front wall 82 and extending between first and second side walls 84, 86 and a bottom 89 extending between bottom portions of the front wall 82, rear wall 88, and the first and second side walls 84, 86. The front wall 82, rear wall 88, the first and second side walls 84, 86 and bottom 89 of the removable insert 80 can form a cavity 85 in which contents can be placed and stored. As shown in FIG. 13A, in some embodiments, the cavity 85 can be an open cavity that allows for the user to insert contents as needed. The open cavity 85 can add to the versatility of the removable insert 80. Additionally, the open cavity 85 can facilitate the storage of the removable insert 80. For example, in some embodiments as shown in FIGS. 12 and 13B, the front wall 82 and the first and second side walls 84, 86 can comprise creases 82C and 86C to permit the removable insert 80 to fold as shown in FIG. 13B. In this manner, the removable insert 80 can be easily stored when not in use or holding contents. In some embodiments, while the front wall 82, rear wall 88, and/or the first and second side walls 84, 86 may have sleeves or pockets on them, the cavity 85 can still be open to allow for insertion of various contents.

In some embodiments, handles 81 can be provided on the removable insert 80 to aid in carrying the removable insert 80. The handles 81 can also aid in placing the removable insert 80 into and removing the removable insert 80 from the cavity 25 of the backpack 10. For example, a handle 81 can be on the front wall 82 of the removable insert 80 and handle 81 can be on the rear wall 88 of the removable insert 80 as shown in FIG. 12. In some embodiments, handles 81 can be on the first and second side walls 84, 86 of the removable insert 80.

The insert 80 can comprise one or more fasteners, such as one or more magnets, on the front wall 82 that can be alignable with and engage the one or more fasteners of the front wall 12 of the backpack 10 to align and hold the removable insert 80 in the cavity 25 of the backpack 10. For example, as shown in FIG. 12, the one or more fasteners of the removable insert 80 can comprise a first front wall magnet 83 and a second front wall magnet 87 positioned in a horizontal plane on a middle portion 82$B_1$ of the exterior face 82B of the front wall 82. The first and second front wall magnets 83, 87 on the removable insert 80 can be configured to engage the first and second front wall magnets 46, 48 on the interior face 12C of the front wall 12 of the backpack 10 to hold and align the removable insert 80 in the interior cavity 25 of the backpack 10.

In some embodiments, the rear wall 88 of the removable insert 80 can comprise one or more fasteners that can be alignable with and engage the one or more fasteners of the rear panel 16 of the backpack 10 to align the removable insert 80 in the cavity 25 of the backpack 10. For example, in some embodiments, as shown in FIG. 12, the one or more fasteners of the rear wall 88 of the removable insert 80 can comprise a rear wall magnet 88A that can be alignable with the middle rear panel magnet 42 on the rear panel 16 of the backpack 10. As described above, the first and second front wall magnets 46, 48 combined can have a stronger magnetic pull than the magnetic pull of the middle rear panel magnet 42. When the rear panel 16 of the backpack 10 is closed, the first and second front wall magnets 83, 87 on the removable insert 80 align with the first and second front wall magnets 46, 48 of the front wall 12 of the backpack 10 and the rear wall magnet of the insert that aligns with the middle rear panel magnet 42 of the rear panel 16 of the backpack 10. With stronger magnetic pull of first and second front wall magnets 46, 48, when the rear panel 16 of the backpack 10 is moved to an opened position, the removable insert 80 stays within the cavity 25 of the backpack 10.

Additionally, to help align and hold the removable insert 80 within cavity 25 of the backpack 10, the bottom 89 of the removable insert 80 can comprise one or more fasteners that can be alignable with and engage the one or more fasteners of the bottom 18 of the backpack 10. For example, in some embodiments, as shown in FIG. 13C, the one or more fasteners of the bottom 89 of the removable insert 80 can comprise one or more bottom magnets 89A, 89B, 89C, 89D that can be alignable with the bottom magnets 50, 52, 54, 56 of the bottom 18 of the backpack 10. The bottom 89 of the removable insert 80 can comprise an interior face 89E and exterior face 89F. In some embodiments, four magnets 89A, 89B, 89C, 89D of the bottom 89 of the removable insert 80 can be positioned proximal to the exterior face 89F of the bottom 89 of removable insert 80. When the removable insert 80 is placed in the cavity 25 of the backpack 10, the four magnets 89A, 89B, 89C, 89D of the bottom 89 of the removable insert 80 can be aligned with the four magnets 50, 52, 54, 56 of the backpack 10 configured to align and hold the removable insert 80 in an interior cavity 25 of the backpack 10. The spacing of the four bottom magnets 89A, 89B, 89C, 89D of the bottom 89 of the removable insert 80 and the spacing of the four bottom magnets 50, 52, 54, 56 of the bottom 18 of the backpack 10 can contribute to the stability the removable insert 80 in the cavity 25 of the backpack 10.

Referring to FIGS. 10 and 14-19, an embodiment of a cooler insert 90 is provided that can be used in the backpack 10 of the backpack system 60. The cooler insert 90 can comprise waterproof and insulating material to keep contents within eh cooler insert 90 cold and to contain moisture within the cooler insert 90. The addition of the cooler insert 90 can increase the versatility of the backpack 10 and backpack system 60.

The cooler insert 90 can comprise a front wall 90 having an interior face 92A (see FIG. 19) and an exterior face 92B and a first side wall 94 extending from a first side of the front wall 92 and a second side wall 96 extending from a second side of the front wall 92 opposite the first side wall 94. The cooler insert 90 can also comprise a rear wall 98 opposite the front wall 92 and extending between first and second side walls 94, 96. The cooler insert 90 can also comprise a bottom 99 extending between bottom portions of the front wall 92, rear wall 98, and the first and second side walls 94, 96. The front wall 92, rear wall 98, the first and second side walls 94, 96 and bottom 99 can form a cavity 95 in which contents can be stored and kept insulated to keep the contents either warm or cool. In some embodiments, handles 91 can be provided on the cooler insert 90 to aid in carrying the cooler insert 90 and to aid in placing the cooler insert 90 into and removing the cooler insert 90 from the cavity 25 of the backpack 10. For example, a handle 91 can be on the front wall 92 and handle 91 can be on the rear wall 98 as shown in FIGS. 14-17A. In some embodiments, handles 91 can be on the first and second side walls 94, 96.

Additionally, the cooler insert 90 can comprise a top panel 100 having an interior face 100A and exterior face 100B. The top panel 100 can extend between top portions of the front wall 92, the rear wall 98 and the first and second side walls 94, 96 and can selectively engage the front wall 92 and the first and second side walls 94, 96 to permit the top panel 100 to open to access the cavity 95 and to close, or shut, to cover and seal the cavity 95. For example, the top panel 100 can comprise a fastener, such as a zipper 102, for securing the top panel 100 to the front wall 92 and at least a portion of the first and second side walls 94, 96 such that the top panel 100 is openable and closeable. In some embodiments, the fastener for securing the top panel 100 of cooler insert 90 to the front wall 92 and the first and second side walls 94, 96 can comprise a waterproof zipper 102. Any zipper of the backpack system 60 may be any zipper known by one skilled in the art. One or more of the zippers on the backpack system 60 can be a waterproof zipper like waterproof zipper 102. The waterproof zipper 102 may comprise a pull tab 102A attached to the slider 102B for locking and unlocking locking elements, or teeth, of the waterproof zipper 102 by pulling the pull tab 102A in different, opposing directions. The waterproof zipper 102 can provide waterproof protection, where the sheaths 102C of the zipper 102 substantially, or wholly, cover the locking elements, or teeth of the zipper 102. Though shown, but not identified in the figures, the zippers of the backpack 10 can be waterproof zippers that include sheaths to protect the locking elements of the zippers.

Figure 14:
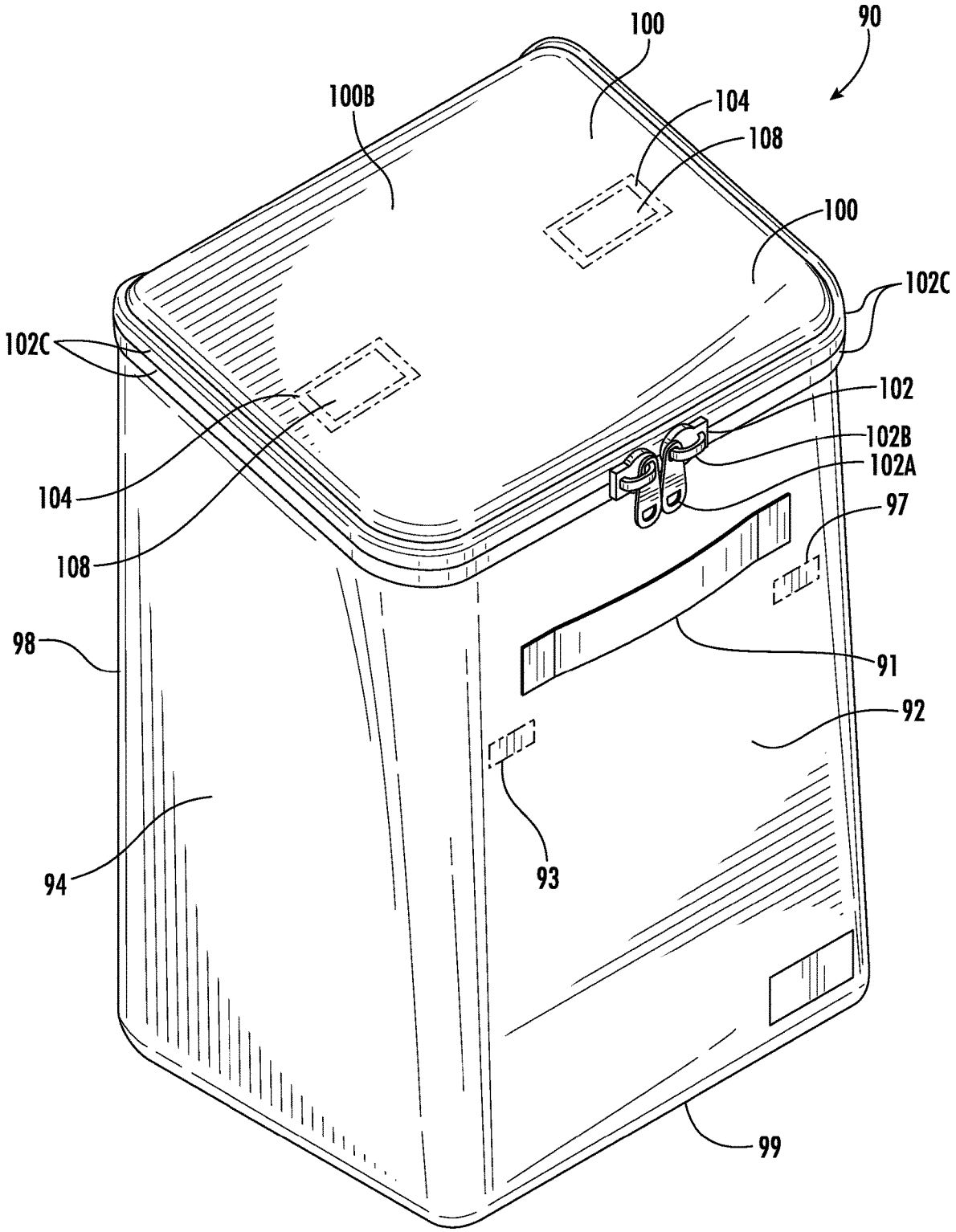
FIG. 14 illustrates a top perspective view of an embodiment of a cooler insert for an embodiment of the backpack system according to the present subject matters.
Figure 15:
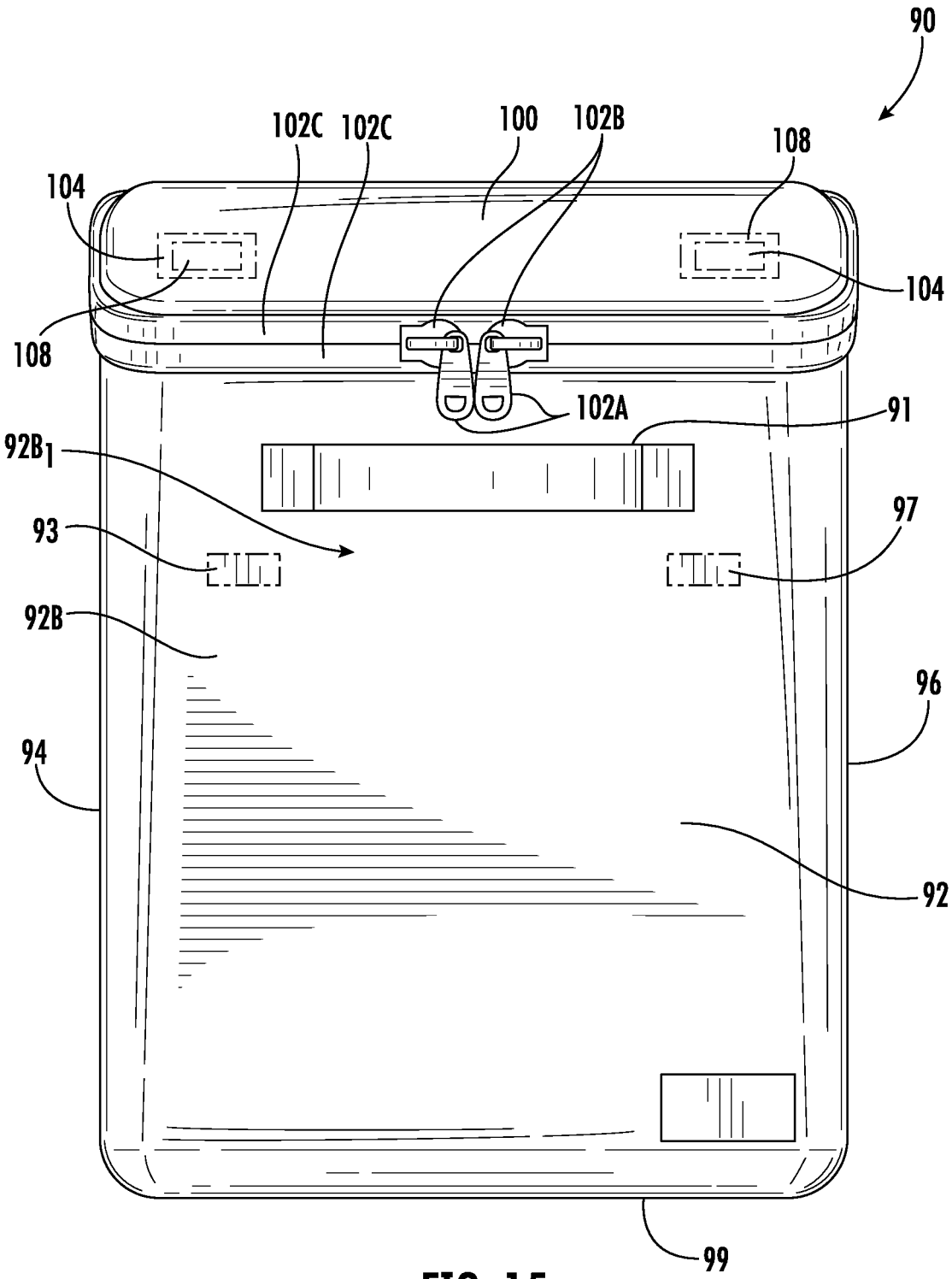
FIG. 15 illustrates a front side plan view of the embodiment of the cooler insert according to FIG. 14.
Figure 16:
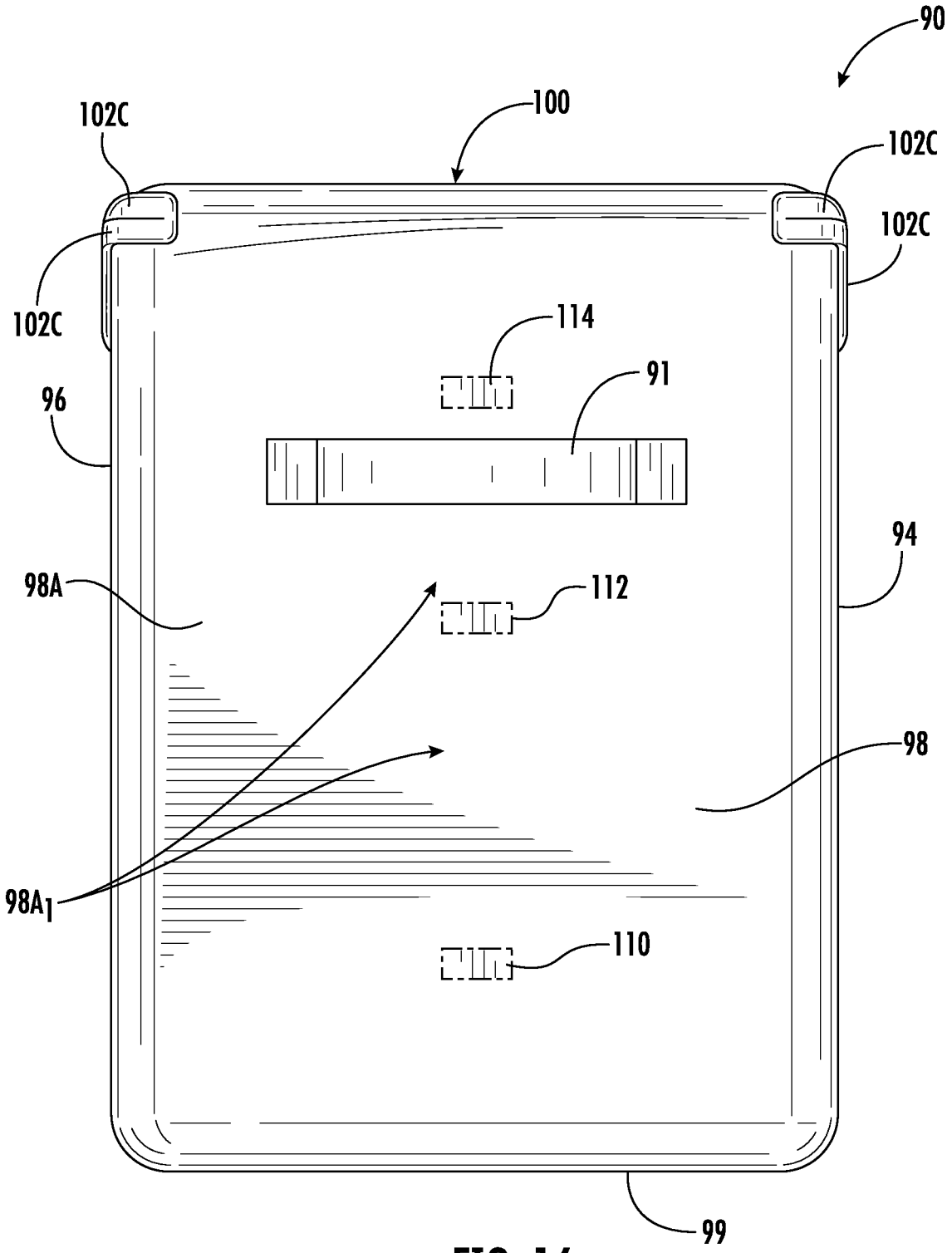

The cooler insert 90 can comprise one or more fasteners, such as one or more magnets, on the front wall 92 that can be alignable with and engage the one or more fasteners of the front wall 12 of the backpack 10 to align and hold the cooler insert 90 in the cavity 25 of the backpack 10. For example, as shown in FIGS. 14 and 15, the one or more fasteners of the cooler insert 90 can comprise a first front wall magnet 93 and a second front wall magnet 97 positioned in a horizontal plane on a middle portion 92$B_1$ of the exterior face 92B of the front wall 92. The first and second front wall magnets 93, 97 on the cooler insert 90 can be configured to engage the first and second front wall magnets 46, 48 on the interior face 12C of the front wall 12 of the backpack 10 to hold and align the cooler insert 90 in the interior cavity 25 of the backpack 10.

In some embodiments, the cooler insert 90 can also have one or more fasteners that correspond to and match with the one or more fasteners on the rear panel 16 of the backpack 10. The one or more fasteners on the cooler insert 90 and the one or more fasteners on the rear panel 16 of the backpack 10 can be used for aligning and maintaining the position of the cooler insert 90 with respect to the rear panel 16 of the backpack 10 and the top panel 20 of the backpack 10 so that the top panel 100 of the cooler insert 90 can be properly aligned with the top panel 20 of the backpack 10. For example, in some embodiments, as show in FIG. 11, the rear wall 98 of the cooler insert 90 can comprise an interior face (not shown) and an exterior face 98A and can further comprise an upper rear magnet 110, a middle rear magnet 112 and a lower rear magnet 114. The upper rear magnet 110, the middle rear magnet 112 and the lower rear magnet 114 can be positioned in a vertical plane on a middle portion 98$A_1$ of the exterior face 98A of the rear wall 98. The upper, middle, and lower rear magnets 110, 112, 114 of the rear wall 98 can be configured to engage the upper, middle, and lower rear sleeve panel magnets 40, 42, 44 on the interior face 16A of the rear panel 16 of the backpack 10 to aid in the alignment and holding of the cooler insert 90 in the cavity 25 of the backpack 10.

Figure 17A:
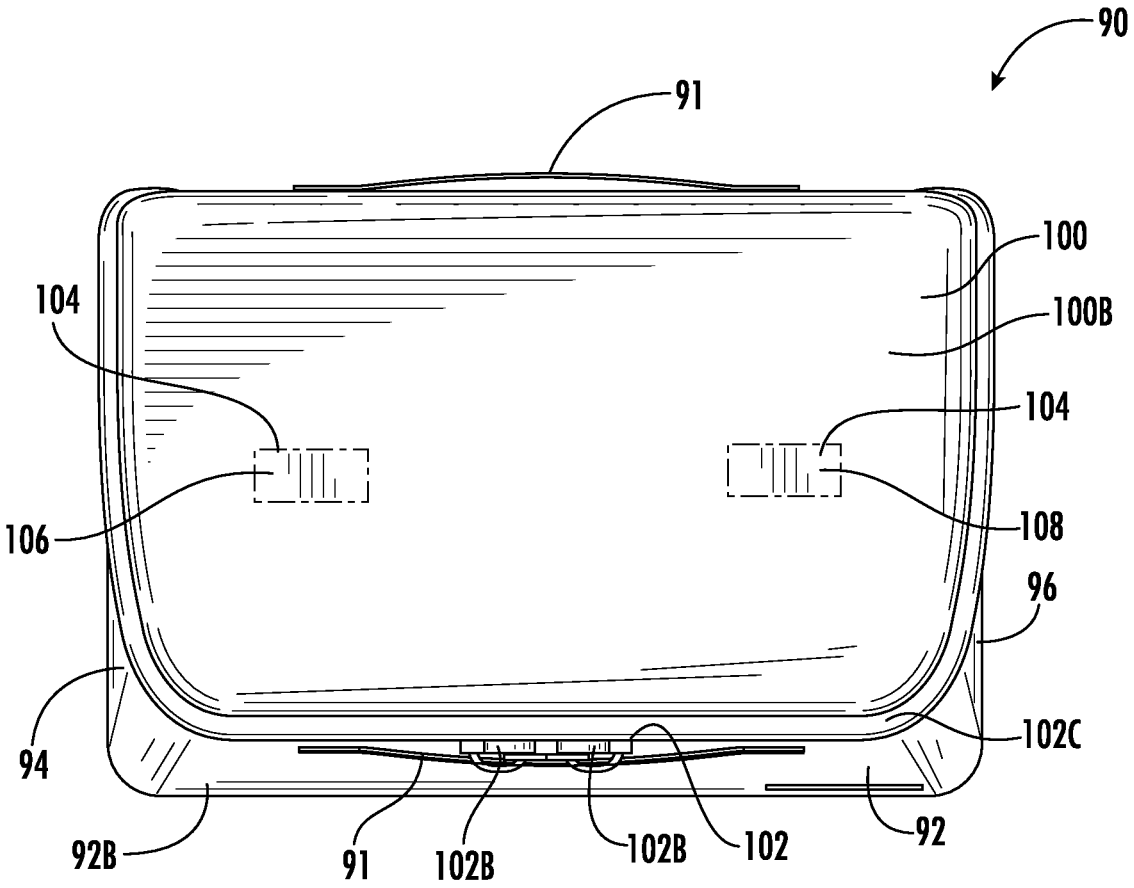
FIG. 17A illustrates a top plan view of the embodiment of the backpack according to FIG. 14.
Figure 17B:
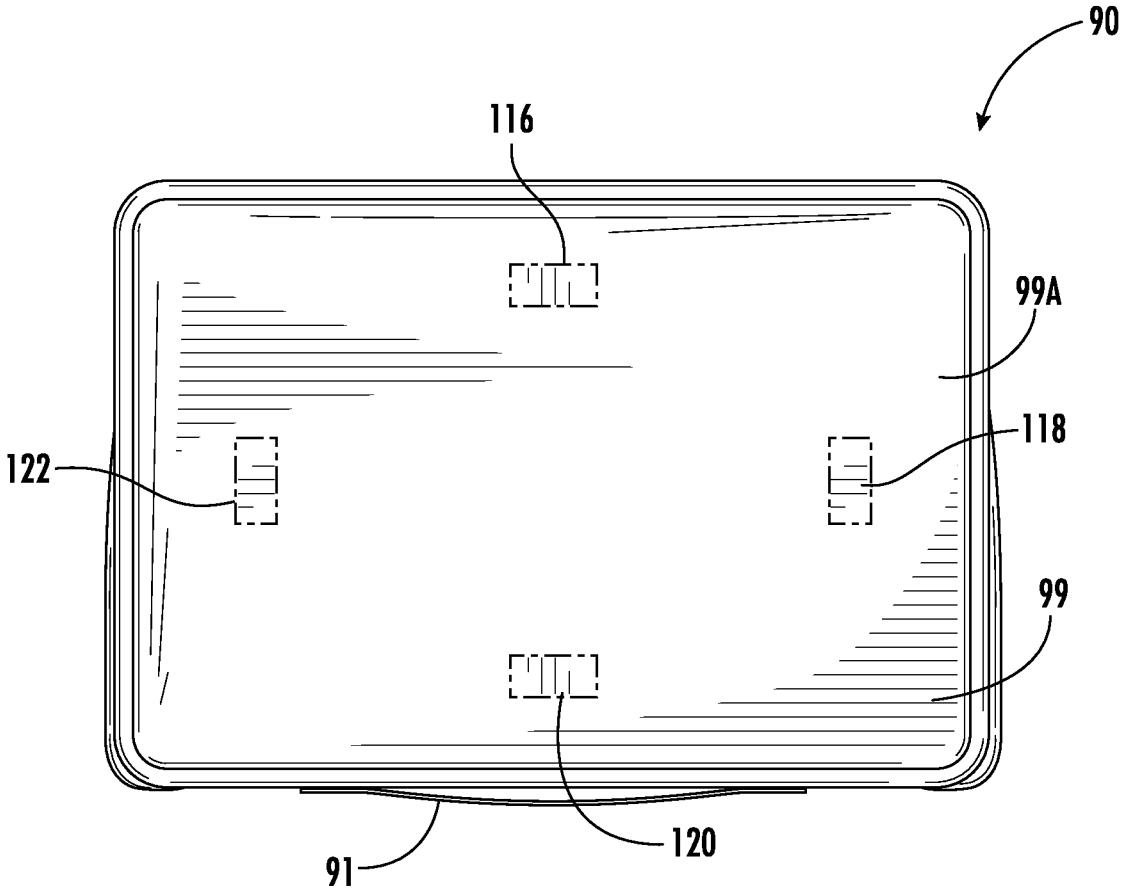
FIG. 17B illustrates a bottom plan view of the embodiment of the backpack according to FIG. 14.

Similarly, to help align and hold the cooler insert 90 within cavity 25 of the backpack 10, the bottom 99 of the cooler insert 90 can comprise one or more fasteners that can be alignable with and engage the one or more fasteners of the bottom 18 of the backpack 10. For example, in some embodiments, as shown in FIG. 17B, the one or more fasteners of the bottom 99 of the cooler insert 90 can comprise one or more bottom magnets 116, 118, 120, 122 that can be alignable with the bottom magnets 50, 52, 54, 56 of the bottom 18 of the backpack 10. The bottom 99 of the cooler insert 90 can comprise an interior face (not shown) and exterior face 99A. In some embodiments, four magnets 116, 118, 120, 122 of the bottom 99 of the cooler insert 90 can be positioned proximal to the exterior face 99A of the bottom 99 of cooler insert 90. When the cooler insert 90 is placed in the cavity 25 of the backpack 10, the four magnets 116, 118, 120, 122 of the bottom 99 of the cooler insert 90 can be aligned with the four magnets 50, 52, 54, 56 of the backpack 10 so as to align and hold the cooler insert 90 in an interior cavity 25 of the backpack 10. The spacing of the four bottom magnets 116, 118, 120, 122 of the bottom 99 of the cooler insert 90 and the spacing of the four bottom magnets 50, 52, 54, 56 of the bottom 18 of the backpack 10 can contribute to the stability the cooler insert 90 in the cavity 25 of the backpack 10.

Figure 18:
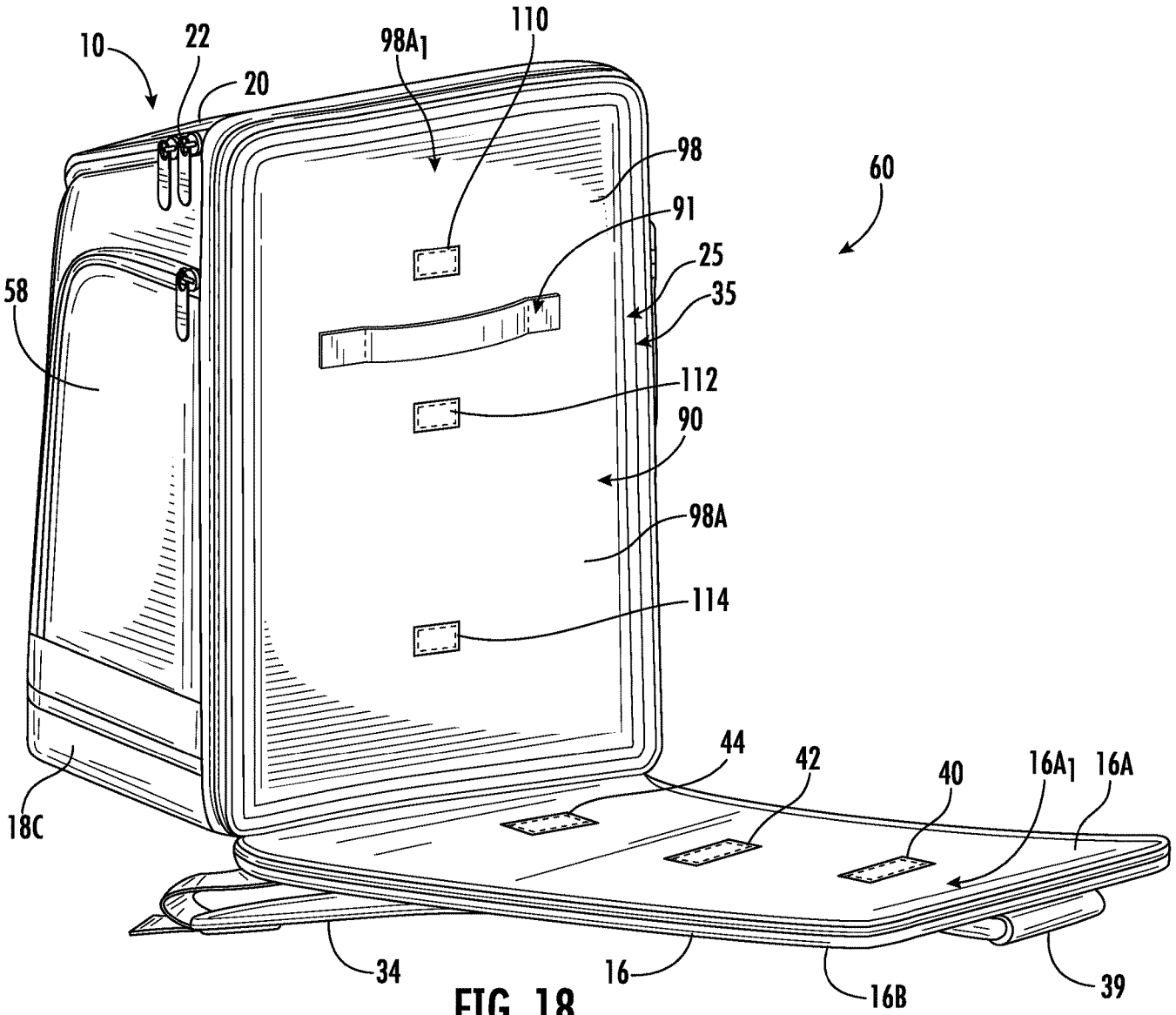
FIG. 18 illustrates a rear side plan view of the embodiment of the backpack according to FIG. 14.
Figure 19:
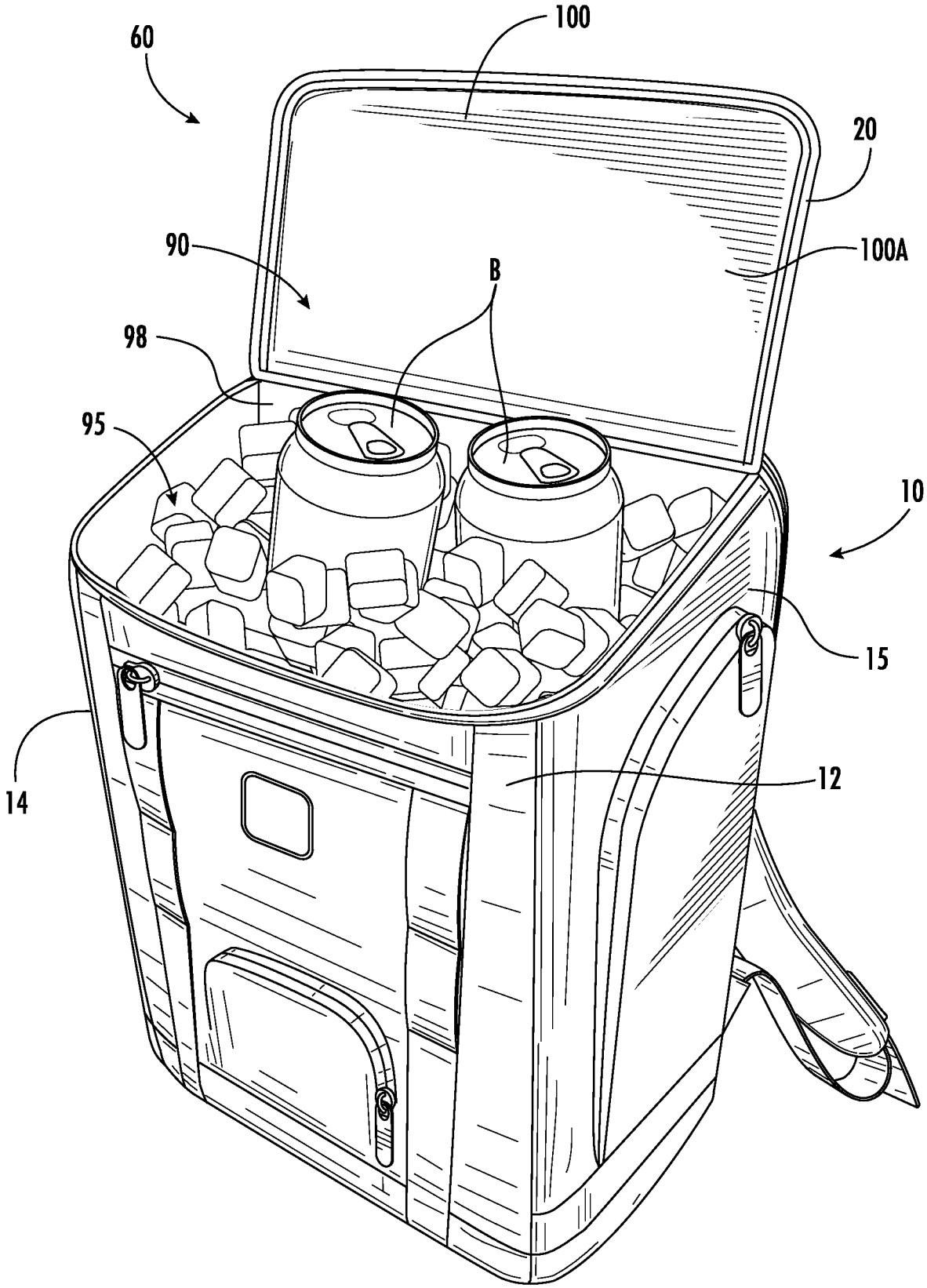
FIG. 19 illustrates a perspective view of the embodiment of the backpack system with the embodiment of the backpack according to FIG. 1 having the cooler insert according to FIG. 14 inserted therein and the top panel of the backpack and the top panel of the cooler insert opened.

Additionally, the top panel 100 of the cooler insert 90 can also comprise at least one fastener 104 that can be alignable with and can engage the at least one fastener 24 of the panel 20 of the backpack 10 when the cooler insert 90 is placed in the cavity 25 of the backpack 10. For example, in some embodiments, as shown in FIGS. 14 and 17, at least one fastener 104 of the top panel 100 of the cooler insert 90 can be positioned proximal the exterior face 100B of the top panel 100. In some embodiments, the at least one fastener 104 of the top panel 100 of the cooler insert 90 can comprise a first top panel magnet 106 and a second top panel magnet 108 configured to engage the first and second magnets 26, 28 on the interior face 20A of the top panel 20 of the backpack 10 to permit the opening of the top panel 100 of the cooler insert 90 when opening the top panel 20 of the backpack 10 as shown in FIG. 19. Once the cooler insert 90 is placed in the cavity 25 of the backpack 10 as shown in FIG. 18, the first and second top panel magnets 106, 108 of the cooler insert 90 can be aligned with the first and second magnets 26, 28 of the top panel 20 of the backpack 10 such that the magnets 26, 106 and the magnets 28 and 108 respectively engage each other. As an example, once the users of the backpack 10 and cooler insert 90 is at a location where they want to access the contents, such as beverages B, in the cavity, the one or more sliders 102A of zipper 102 of the top panel 100 of the cooler insert 90 can be moved to an open position so that the top panel 100 of the cooler insert 90 can be free to open and close as the top panel 20 of the backpack 10 opens and closes.

Referring to FIGS. 18 and 19, the use of the backpack system 60 with the cooler insert 90 is described in more detail. As shown in FIG. 18, the cooler insert 90 can be inserted into the cavity 25 of the backpack 10 through the rear opening 35 once the rear panel 16 is opened. Upon insertion of the cooler insert 90, the four magnets 116, 118, 120, 122 of the bottom 99 of the cooler insert 90 shown in FIG. 17B align with and engage with the four magnets 50, 52, 54, 56 of the bottom 18 of the backpack 10 shown in FIGS. 78 and 8. Additionally, the first and second front wall magnets 93, 97 on the cooler insert 90 shown in FIGS. 14 and 15 align with and engage the first and second front wall magnets 46, 48 on the interior face 12C of the front wall 12 of the backpack 10 shown in FIG. 8. In this manner, the cooler insert 90 can be properly aligned and held in an interior cavity 25 of the backpack 10. Once the cooler insert 90 is inserted into the cavity 25 of the backpack 10, the rear panel 16 can be closed. With the rear panel 16 closed, the upper, middle, and lower rear magnets 110, 112, 114 of the rear wall 98 shown in FIGS. 16 and 18 align with and engage the upper, middle, and lower rear sleeve panel magnets 40, 42, 44 on the interior face 16A of the rear panel 16 of the backpack 10 shown in FIGS. 8 and 18 to aid in the alignment and holding of the cooler insert 90 in the cavity 25 of the backpack 10. In this manner, the cooler insert 90 is properly and securely stored within the backpack 10. Additionally, the first and second top panel magnets 106, 108 of the cooler insert 90 shown in FIGS. 14 and 15 can be aligned with the first and second magnets 26, 28 of the top panel 20 of the backpack 10 shown in FIG. 9. The sliders 102A of zipper 102 of the top panel 100 of the cooler insert 90 shown in FIGS. 14 and 15 can be moved to an open position so that the top panel 100 of the cooler insert 90 can be free to open and close as the top panel 20 of the backpack 10 as shown in FIG. 19 to allow access to the cavity 95 of the cooler insert 90 and its contents such as beverages B and/or ice I. Once the user of the backpack 10 is finished using the cooler insert 90 or desires to change the insert for a different use, the rear panel 16 can be opened again and the cooler insert 90 can be removed. Another insert, such as removable insert 80 and or the computer sleeve insert 70, can then be placed in the cavity 25 of the backpack 10 and the rear panel 16 can be closed. Alternatively, the cavity 25 of the backpack 10 can be left empty and/or filled with contents as the user desires using the accesses through either the opening 35 formed at the rear panel 16 or the opening 29 formed at the top panel 20 of the backpack 10.

Thus, a method of using a cooler insert in a backpack is provided. The method can comprise providing a backpack and a cooler insert. The backpack can comprise a front wall having an interior face and an exterior face and a first side wall extending from a first side of the front wall and a second side wall extending from a second side of the front wall opposite the first side wall. The backpack can comprise a bottom extending between bottom portions of the front wall and the first and second side walls and a top panel having an interior face and exterior face and extending between top portions of the front wall and the first and second side walls. The top panel can comprise a fastener for securing the top panel to the front wall and at least a portion of the first and second side walls such that the top panel is openable and closeable. Additionally, the top panel can have at least one fastener positioned proximal the interior face of the top panel of the backpack. The backpack can comprise a rear panel opposite the front wall and extending between first and second side walls, the bottom, and the top panel. The rear panel can comprise a fastener for securing the rear panel to the top panel and at least a portion of the first and second side walls such that the rear panel is openable and closeable.

The cooler insert can comprise a front wall having an interior face and an exterior face and a first side wall extending from a first side of the front wall and a second side wall extending from a second side of the front wall opposite the first side wall. The cooler insert can also comprise a rear wall opposite the front wall and extending between first and second side walls and a bottom extending between bottom portions of the front wall, rear wall, and the first and second side walls. The cooler insert can comprise a top panel having an interior face and exterior face and extending between top portions of the front wall, the rear wall and the first and second side walls. The top panel of the cooler insert can comprise a fastener for securing the top panel to the front wall and at least a portion of the first and second side walls such that the top panel is openable and closeable. Additionally, at least one fastener can be positioned proximal the exterior face of the top panel of the cooler insert.

With the backpack and the cooler insert, the method can further comprise opening the rear panel of the backpack and inserting the cooler insert into the cavity of the backpack. The at least one fastener on the top panel of the backpack can be engaged with the at least one fastener of the top panel of the cooler insert such that, when opening the top panel of the backpack, the top panel of the cooler insert opens. Once the cooler insert is inserted into the cavity of the backpack, the rear panel of the backpack can be closed. When the user is through using the cooler insert, the rear panel of the backpack can be opened, and the cooler insert removed from the cavity of the backpack. Further, if the user wants to use the backpack for another purpose, a second insert with a different configuration can be inserted into the cavity of the backpack and the rear panel of the backpack can be closed.

Particular embodiments and features have been described with reference to the drawings. It is to be understood that these descriptions are not limited to any single embodiment or any particular set of features, and that similar embodiments and features may arise, or modifications and additions may be made without departing from the scope of these descriptions and the spirit of the appended claims.

What is claimed is:

1. A backpack system comprising:

a backpack comprising:

a front wall having an interior face and an exterior face with one or more front wall magnets on the interior face of the front wall;

a first side wall extending from a first side of the front wall and a second side wall extending from a second side of the front wall opposite the first side wall;

a bottom extending between bottom portions of the front wall and the first and second side walls, a top panel having an interior face and exterior face and extending between top portions of the front wall and the first and second side walls, the top panel comprising a fastener for securing the top panel to the front wall and at least a portion of the first and second side walls such that the top panel is openable and closeable;

a rear panel opposite the front wall and extending between first and second side walls, the bottom, and the top panel, the rear panel comprising a fastener for securing the rear panel to the top panel and at least a portion of the first and second side walls such that the rear panel is openable and closeable and the rear panel comprising an interior face and an exterior face with one or more rear panel magnets on the interior face of the rear panel; and at least one fastener positioned proximal the interior face of the top panel; and a cooler insert comprising:

a front wall having an interior face and an exterior face;

a first side wall extending from a first side of the front wall and a second side wall extending from a second side of the front wall opposite the first side wall;

a rear wall opposite the front wall and extending between first and second side walls;

a bottom extending between bottom portions of the front wall, rear wall, and the first and second side walls;

a top panel having an interior face and exterior face and extending between top portions of the front wall, the rear wall and the first and second side walls, the top panel comprising a fastener for securing the top panel to the front wall and at least a portion of the first and second side walls such that the top panel is openable and closeable; and at least one fastener positioned proximal the exterior face of the top panel;

the at least one fastener positioned proximal the exterior face of the top panel configured to engage the at least one fastener on the interior face of the top panel of the backpack to permit the opening of the top panel of the cooler insert when opening the top panel of the backpack and at least one of the one or more front wall magnets being configured to engage the front wall of the cooler insert and at least one of the one or more rear panel magnets being configured to engage a rear wall of a backpack insert such that the engaged front wall magnets have a stronger magnetic pull than the engaged rear panel magnets to hold the cooler insert within the backpack when the rear panel is opened and the engaged rear panel magnets are disengaged.

2. The backpack system according to claim 1, wherein the one or more front wall magnets of the front wall of the backpack further comprises a first front wall magnet and a second front wall magnet positioned in a horizontal plane on a middle portion of the interior face of the front wall of the backpack, the first and second front wall magnets configured to hold an insert in an interior cavity of the backpack formed by the front wall, the bottom, and the first and second side walls.

3. The backpack system according to claim 2, further comprising a second insert comprising:

a front wall having an interior face and an exterior face;

a first side wall extending from a first side of the front wall and a second side wall extending from a second side of the front wall opposite the first side wall;

a rear wall opposite the front wall and extending between first and second side walls;

a bottom extending between bottom portions of the front wall, rear wall, and the first and second side walls; and a first front wall magnet and a second front wall magnet positioned in a horizontal plane on a middle portion of the exterior face of the front wall, the first and second front wall magnets on the second insert configured to engage the first and second front wall magnets on the interior face of the front wall of the backpack to hold the second insert in the interior cavity of the backpack.

4. The backpack according to claim 3, wherein the bottom of the backpack comprises an interior face and exterior face and a one or more bottom magnets positioned proximal to the interior face of the bottom of the backpack and the bottom of the second insert comprises an interior face and exterior face and one or more bottom magnets positioned proximal to the exterior face of the bottom, the one or more bottom magnets of the second insert being alignable with the one or more bottom magnets of the backpack configured to removably hold the second insert in an interior cavity of the backpack.

5. The backpack system according to claim 3, wherein the one or more rear panel magnets of the rear panel of the backpack comprises an upper rear panel magnet, a middle rear panel magnet and a lower rear panel magnet positioned in a vertical plane on a middle portion of the interior face of the rear panel of the backpack.

6. The backpack system according to claim 5, wherein the rear wall of the second insert comprises a rear wall magnet that aligns with the middle rear panel magnet on the rear panel of the back pack and wherein the first and second front wall magnets combined to have a stronger magnetic pull than the magnetic pull of the middle rear panel magnet, such that the first and second front wall magnets on the second insert align with the first and second front wall magnets of the front wall of the backpack and the rear wall magnet of the second insert that aligns with the middle rear panel magnet of the rear panel of the backpack so that when the rear panel moves to an opened position, the insert stays within the cavity of the backpack.

7. The backpack system according to claim 5, further comprising a computer sleeve insert having a front sleeve panel and a rear sleeve panel, with the rear sleeve panel comprising an exterior face and further comprising an upper rear sleeve panel magnet, a middle rear sleeve panel magnet and a lower rear sleeve panel magnet positioned in a vertical plane on a middle portion of the exterior face of the rear sleeve panel with the upper, middle, and lower rear sleeve panel magnets configured to engage the upper, middle, and lower rear sleeve panel magnets on the interior face of the rear panel of the backpack to removably hold the computer sleeve insert to the interior face of the rear panel of the backpack.

8. The backpack according to claim 1, wherein the fastener for securing the top panel of the cooler insert comprises a waterproof zipper.

9. A method of using a cooler insert in a backpack, the method comprising:

providing a backpack comprising:

a front wall having an interior face and an exterior face with one or more front wall magnets on the interior face of the front wall;

a first side wall extending from a first side of the front wall and a second side wall extending from a second side of the front wall opposite the first side wall;

a bottom extending between bottom portions of the front wall and the first and second side walls, a top panel having an interior face and exterior face and extending between top portions of the front wall and the first and second side walls, the top panel comprising a fastener for securing the top panel to the front wall and at least a portion of the first and second side walls such that the top panel is openable and closeable;

a rear panel opposite the front wall and extending between first and second side walls, the bottom, and the top panel, the rear panel comprising a fastener for securing the rear panel to the top panel and at least a portion of the first and second side walls such that the rear panel is openable and closeable and the rear panel comprising an interior face and an exterior face with one or more rear panel magnets on the interior face of the rear panel; and at least one fastener positioned proximal the interior face of the top panel of the backpack; and providing a cooler insert comprising:

a front wall having an interior face and an exterior face;

a first side wall extending from a first side of the front wall and a second side wall extending from a second side of the front wall opposite the first side wall;

a rear wall opposite the front wall and extending between first and second side walls;

a bottom extending between bottom portions of the front wall, rear wall, and the first and second side walls;

a top panel having an interior face and exterior face and extending between top portions of the front wall, the rear wall and the first and second side walls, the top panel comprising a fastener for securing the top panel to the front wall and at least a portion of the first and second side walls such that the top panel is openable and closeable; and at least one fastener positioned proximal the exterior face of the top panel of the cooler insert;

opening the rear panel of the backpack;

inserting the cooler insert into the cavity of the backpack such that the front wall of the cooler insert engages at least one of the one or more front wall magnets of the front wall;

engaging the at least one fastener on the top panel of the backpack with the at least one fastener of the top panel such that, when opening the top panel of the backpack, the top panel of the cooler insert opens; and closing the rear panel of the backpack such that the rear wall of the cooler insert engages at least one of the one or more rear panel magnets of the rear panel such that the engaged front wall magnets have a stronger magnetic pull than the engaged front wall magnets to hold the cooler insert within the backpack when the rear panel is opened.

10. The method according to claim 9, further comprising opening the rear panel of the backpack and removing the cooler insert from the cavity of the backpack.

11. The method according to claim 10, further comprising inserting a second insert into the cavity of the backpack and closing the rear panel of the backpack.

* * * * *